US010934121B2

(12) United States Patent
Iwamoto

(10) Patent No.: US 10,934,121 B2
(45) **Date of Patent: *Mar. 2, 2021**

(54) POST-PROCESSING APPARATUS

(71) Applicant: KYOCERA Document Solutions Inc., Osaka (JP)

(72) Inventor: Kazuhisa Iwamoto, Osaka (JP)

(73) Assignee: KYOCERA Document Solutions Inc.

( * ) Notice: Subject to any disclaimer, the term of this patent is extended or adjusted under 35 U.S.C. 154(b) by 54 days.

This patent is subject to a terminal disclaimer.

(21) Appl. No.: 16/432,022

(22) Filed: Jun. 5, 2019

(65) Prior Publication Data

US 2019/0284005 A1 Sep. 19, 2019

Related U.S. Application Data

(62) Division of application No. 15/959,374, filed on Apr. 23, 2018, now Pat. No. 10,351,381.

(30) Foreign Application Priority Data

Apr. 27, 2017 (JP) ..... JP2017-088440
Apr. 28, 2017 (JP) ..... JP2017-089624

(51) Int. Cl.
*B65H 31/34* (2006.01)
*B65H 31/30* (2006.01)
(Continued)

(52) U.S. Cl.
CPC ..... *B65H 31/34* (2013.01); *B41J 13/106* (2013.01); *B65H 31/20* (2013.01);
(Continued)

(58) Field of Classification Search
CPC ..... B65H 29/38; B65H 29/44; B65H 29/46; B65H 29/70; B65H 31/26; B65H 31/38;
(Continued)

(56) References Cited

U.S. PATENT DOCUMENTS 8,485,523 B2 * 7/2013 Kimura ..... B65H 33/08 271/220
10,351,381 B2 * 7/2019 Iwamoto ..... B65H 31/34
(Continued)

FOREIGN PATENT DOCUMENTS

JP 2001-130817 5/2001
JP 2002-179326 6/2002
(Continued)

*Primary Examiner* — Jeremy R Severson
(74) *Attorney, Agent, or Firm* — Gerald E. Hespos; Michael J. Porco; Matthew T. Hespos

(57) ABSTRACT

The present application discloses a post-processing apparatus which performs a predetermined process after an image formation process performed by an image formation apparatus. The post-processing apparatus includes an ejection tray, which supports a sheet stack, in which sheets are stacked, and a curl prevention portion including a first tray cursor, which abuts an upper surface of the sheet stack on the ejection tray to prevent the sheet stack from curling. The curl prevention portion includes an angle changer, which changes an inclination angle of the first tray cursor with respect to the ejection tray. The angle changer sets the inclination angle to a first value when a number of sheets is a first number. The angle changer sets the inclination angle to a second value different from the first value when the number of the sheets is a second number different from the first number.

8 Claims, 23 Drawing Sheets

(51) Int. Cl.

| | |
|---|---|
| ***B65H 31/20*** | (2006.01) |
| ***B65H 33/08*** | (2006.01) |
| ***B41J 13/10*** | (2006.01) |
| ***G03G 15/00*** | (2006.01) |

(52) U.S. Cl.
CPC ..... *B65H 31/3063* (2013.01); *B65H 33/08* (2013.01); *G03G 15/6576* (2013.01); *B65H 2301/4225* (2013.01)

(58) Field of Classification Search
CPC .. B65H 2301/4223; B65H 2301/42242; G03G 15/6576
See application file for complete search history.

(56) References Cited

U.S. PATENT DOCUMENTS

| | | | |
|---|---|---|---|
| 2002/0079642 | A1 | 6/2002 | Tamura et al. |
| 2003/0006543 | A1 | 1/2003 | Tamura et al. |
| 2005/0189706 | A1 | 9/2005 | Tamura et al. |
| 2007/0120306 | A1 | 5/2007 | Takemoto et al. |
| 2011/0062648 | A1 | 3/2011 | Kurosu |
| 2011/0241275 | A1 | 10/2011 | Matsuo |

FOREIGN PATENT DOCUMENTS

| | | |
|---|---|---|
| JP | 2003-2516 | 1/2003 |
| JP | 2006-225119 | 8/2006 |
| JP | 2011-79671 | 4/2011 |
| JP | 2011-225371 | 11/2011 |

* cited by examiner

POST-PROCESSING APPARATUS

INCORPORATION BY REFERENCE

This application is a divisional of U.S. patent application Ser. No. 15/959,374, filed on Apr. 23, 2018, which is based on Japanese Patent Application No. 2017-088440 filed on Apr. 27, 2017 and Japanese Patent Application No. 2017-089624 filed on Apr. 28, 2017, in the Japan Patent Office, the entire disclosure of which is hereby incorporated by reference herein.

BACKGROUND

The present disclosure relates to a post-processing apparatus, which performs a predetermined process after an image formation process of forming an image on a sheet.

Various techniques have been developed for preventing a sheet stack from curling on an ejection tray. These techniques use a curl prevention member, which abuts with the upper surface of the sheet stack to prevent the sheet stack from curling on the ejection tray.

SUMMARY

A post-processing apparatus according to one aspect of the present disclosure performs a predetermined post-process after an image formation process for forming an image. The post-processing apparatus includes an ejection tray, which supports a sheet stack ejected after the post-process, and a curl prevention portion including a first tray cursor, which abuts an upper surface of the sheet stack on the ejection tray to prevent the sheet stack from curling, and an angle changer, which changes an inclination angle of the first tray cursor with respect to the ejection tray. The angle changer sets the inclination angle to a first value when a number of sheets forming the sheet stack is a first number. The angle changer sets the inclination angle to a second value different from the first value when the number of the sheets is a second number different from the first number.

DETAILED DESCRIPTION

Figure 1:
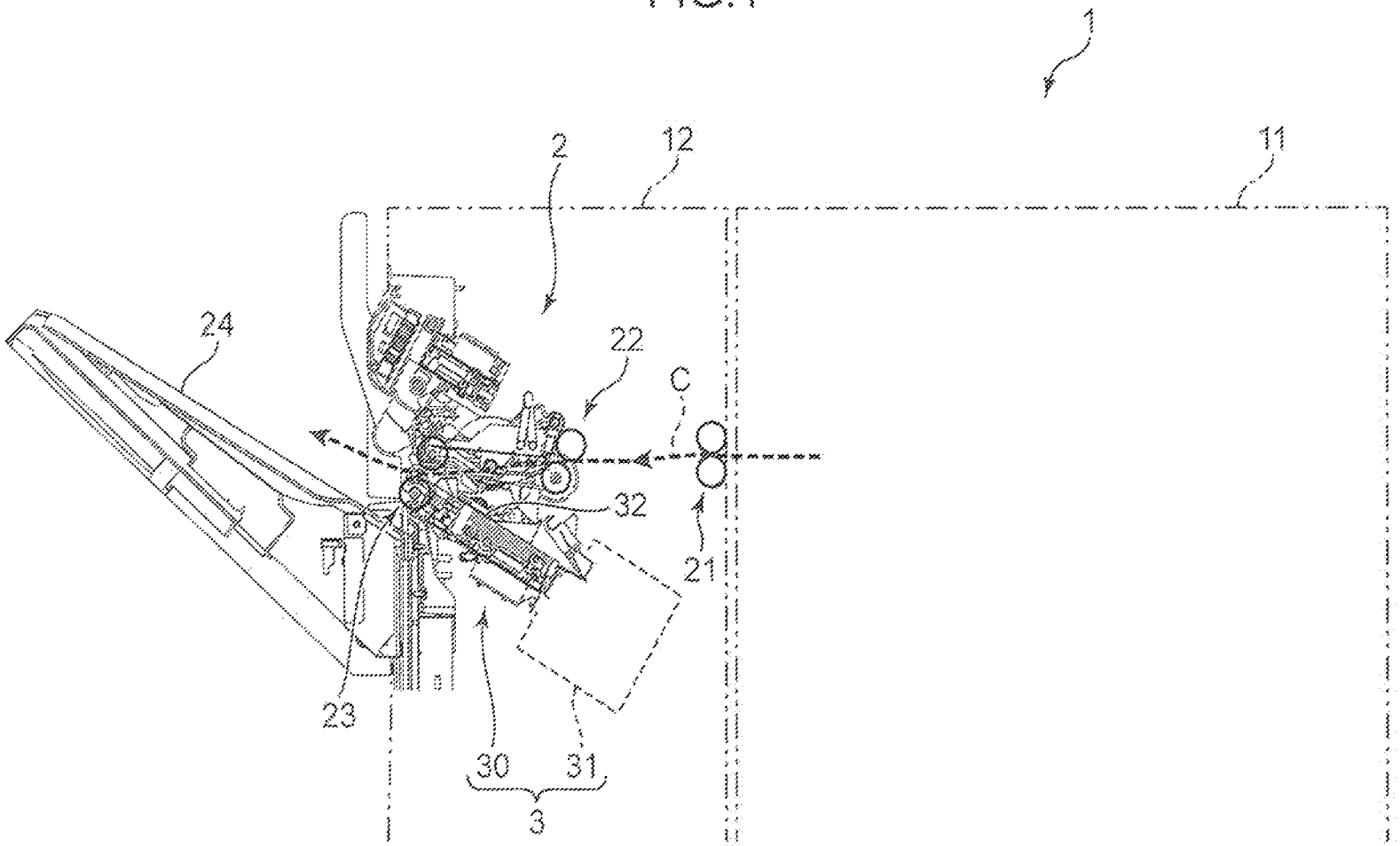
FIG. 1 is a schematic view of an image forming apparatus including an exemplificative post-processing apparatus.

FIG. 1 is a schematic view showing an image formation apparatus 1 which includes a post-processing apparatus 2. In the following description, the terms "upstream" and "downstream" are used on the basis of a sheet conveyance direction. The direction perpendicular to the sheet conveyance direction is referred to as "width direction". The directional terms "leftward" and "rightward" are used only for clarity of description. FIG. 1 shows by chain lines a first housing 11, in which an image formation portion forming an image on a sheet is stored, and a second housing 12, in which the post-processing apparatus 2 performing a predetermined post-process on the sheet after the image formation is stored.

The first housing 11 as an image formation portion includes various devices for electrophotographic image formation or ink-jet image formation. In the case of the electrophotographic image formation, the first housing 11 contains a photosensitive drum, a charger, a developing device, an exposure device, a fixing device and a toner container. In the case of the ink-jet image formation, the first housing 11 contains a recording portion including an ink-jet head, a dryer and an ink tank.

(Overall Configuration of Post-Processing Apparatus)

The post-processing apparatus 2 stored in the second housing 12 performs a predetermined post-process on a sheet or a sheet stack after the image formation process of forming an image on a sheet in the first housing 11. As the post-process, a punching process of perforating a sheet with binding holes, a stapling process of stapling a sheet stack, a middle-folding process of folding a sheet, an alignment operation of adjusting positions of sheets in the width direction so that the side edges of sheets in a sheet stack align with one another, and a change operation of changing an ejection position of sheets in the width direction are exemplified. FIG. 1 shows a post-processing portion 3 having an alignment unit 30 which performs an alignment process as the post-process and a stapler 31 which performs a stapling process.

In addition to the post-processing portion 3, the post-processing apparatus 2 includes a conveyance path C, along which sheets sent from the first housing 11 to the second housing 12 are sequentially conveyed in a predetermined conveyance direction through the post-processing portion 3, and an ejection tray 24 as a final ejection place of the sheets after the post-process. Along the conveyance path C, an import roller pair 21, a first ejection roller pair 22 and a second ejection roller pair 23 are arranged in this order from the upstream side.

The import roller pair 21 is situated at the closest position to the first housing 11 among the import roller pair 21, the first and second ejection roller pairs 22, 23. The import roller pair 21 pulls a sheet after the image formation into the second housing 12. The first ejection roller pair 22 is situated upstream of the post-processing portion 3. The first ejection roller pair 22 sends the sheet into the post-processing portion 3. The second ejection roller pair 23 is situated downstream of the post-processing portion 3. The second ejection roller pair 23 ejects the sheet onto the ejection tray 24. The ejection tray 24 is movable in the vertical direction. Sheets are stacked on the ejection tray 24.

Figure 2:
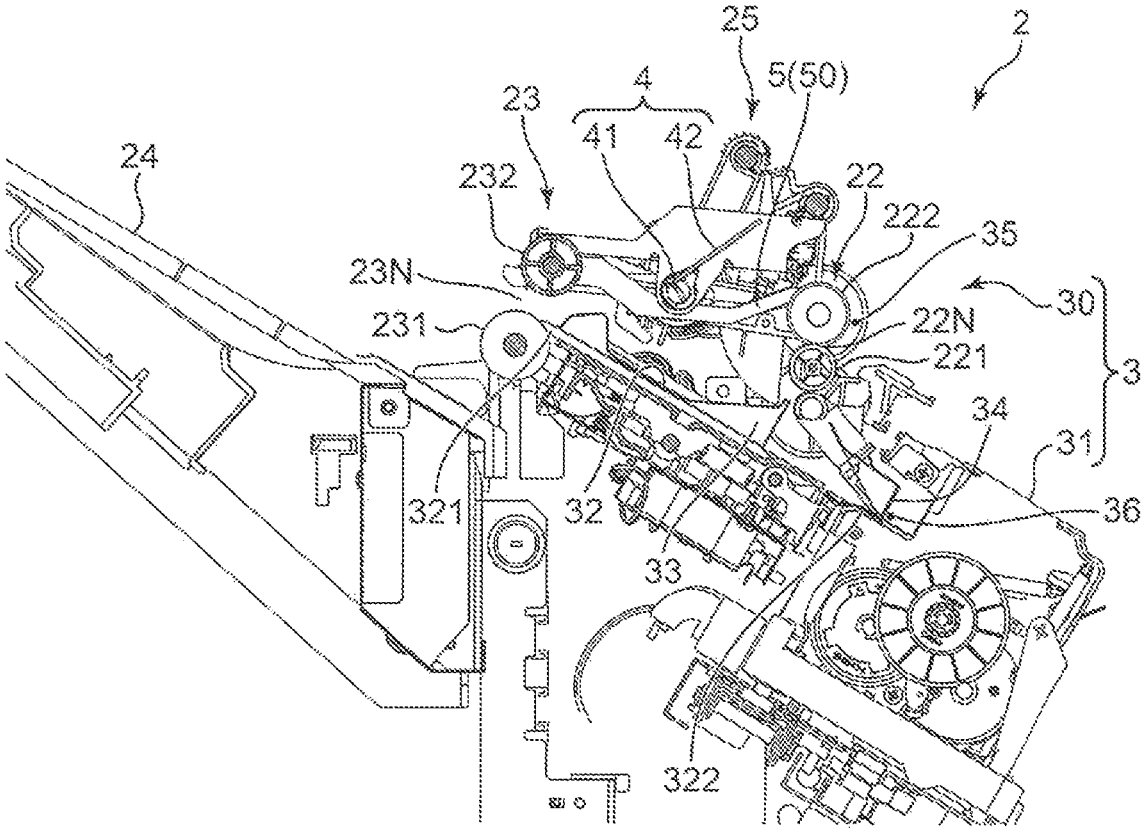
FIG. 2 is a side cross-sectional view of the post-processing apparatus.
Figure 3:
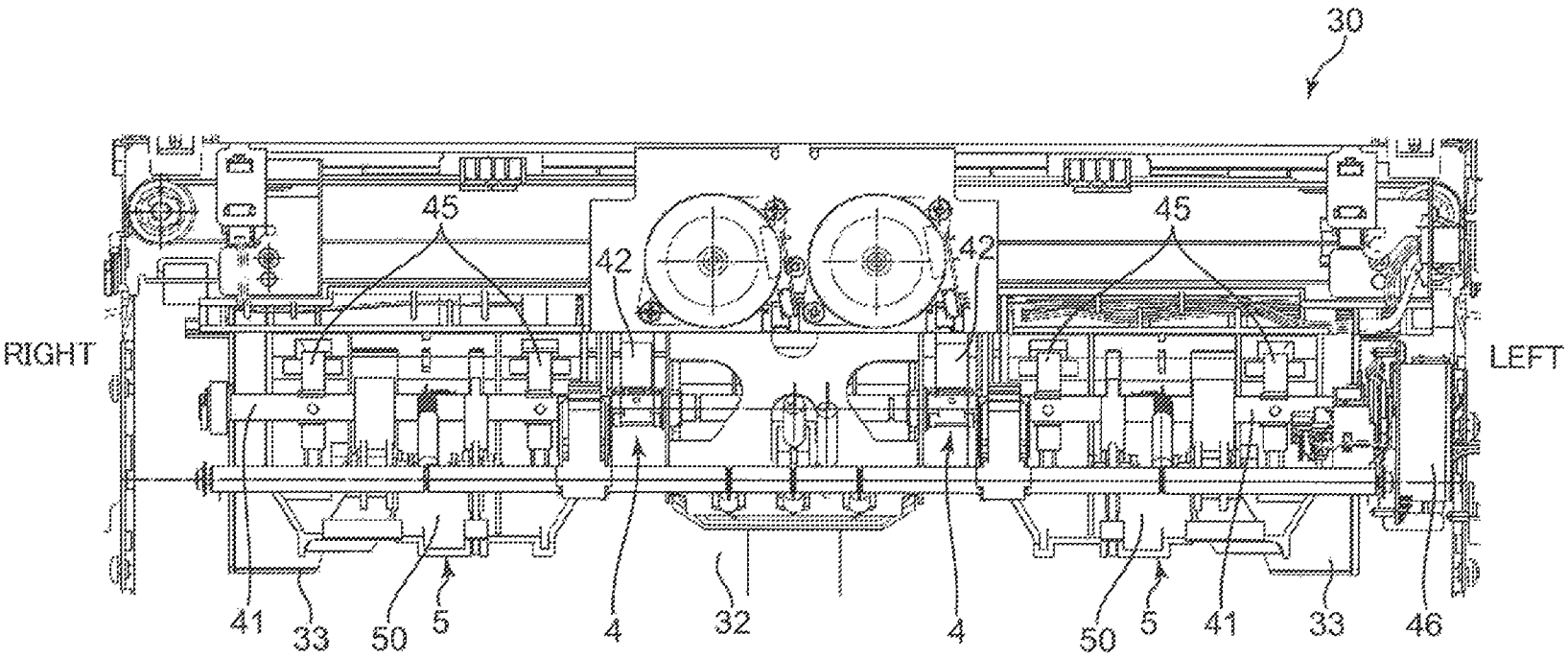
FIG. 3 is a plane view of an alignment unit incorporated in the post-processing apparatus.
Figure 4:
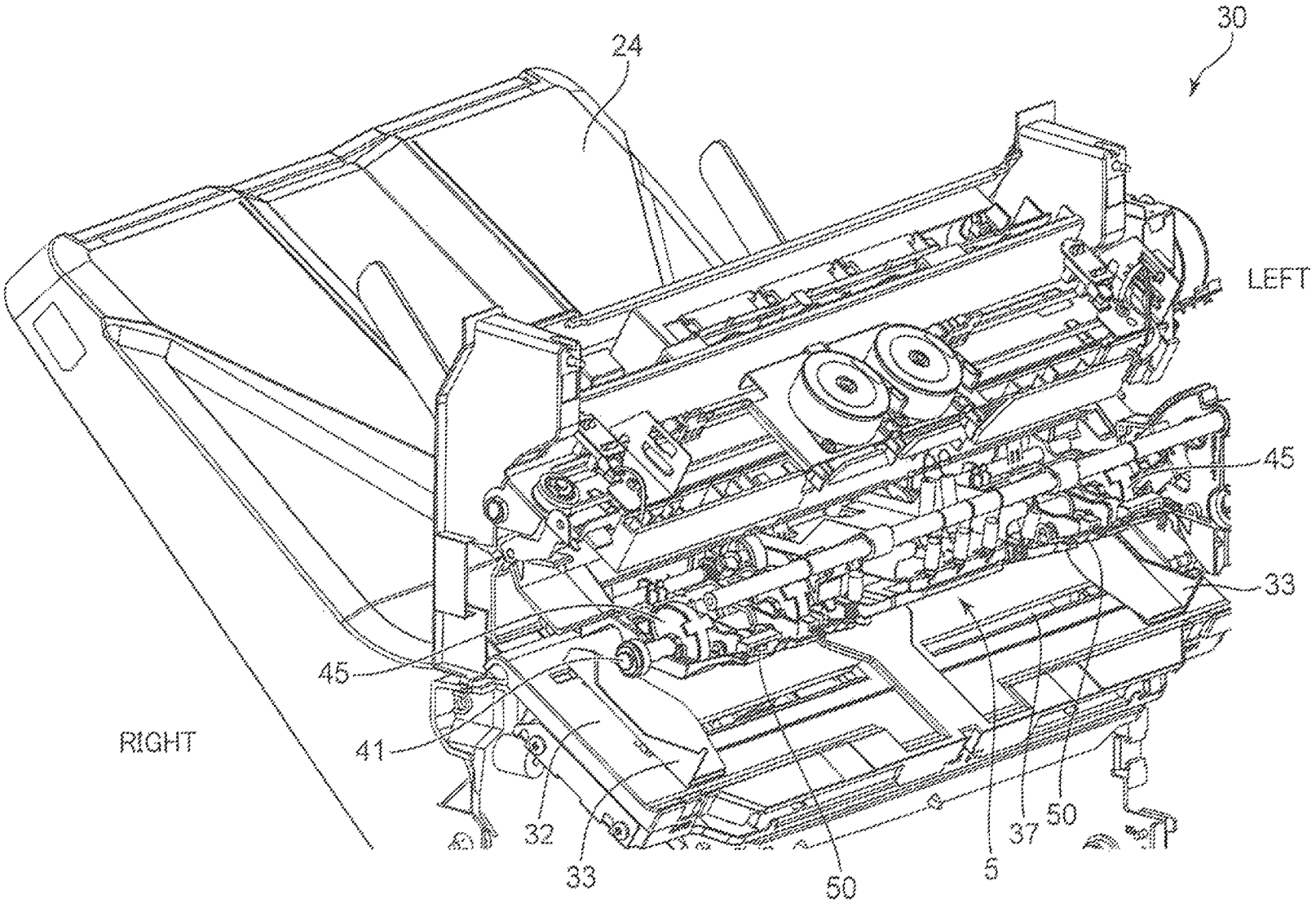
FIG. 4 is a perspective view of the alignment unit.
Figure 11:
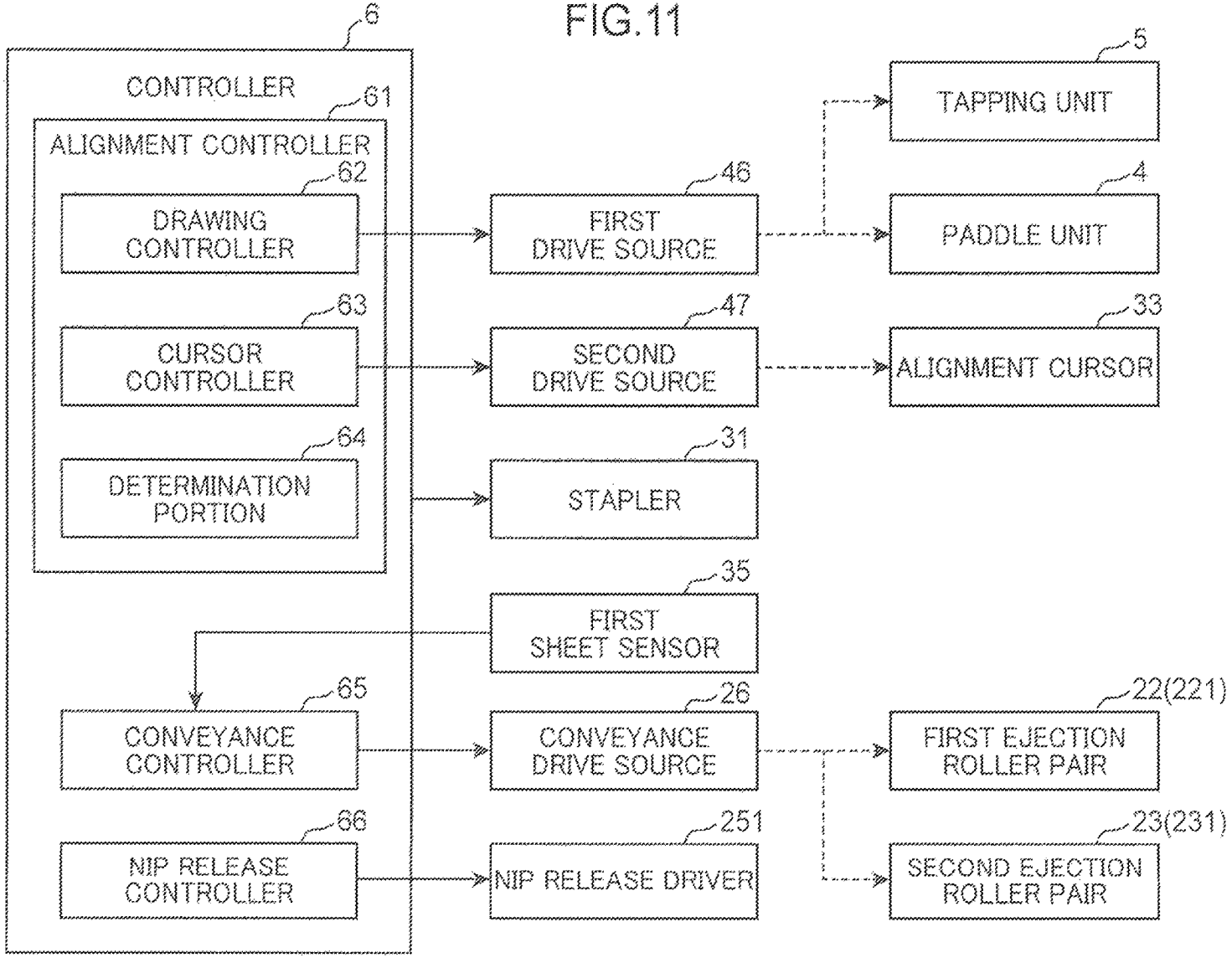
FIG. 11 is a block diagram showing an electrical configuration of the post-processing apparatus.

The structure of the post-processing portion 3 is described with reference to FIGS. 2 to 4. FIG. 2 is a side cross-sectional view of the post-processing portion 3. FIG. 3 is a plane view of the alignment unit 30. FIG. 4 is a perspective view of the alignment unit 30. The first ejection roller pair 22 includes a driving roller 221, which is given a driving force by a conveyance drive source 26 (c.f. FIG. 11), and a driven roller 222, which is rotated along with the rotation of the driving roller 221. The circumferential surface of the driving roller 221 is in abutment with the circumferential surface of the driven roller 222 under a predetermined nip pressure to form a first nip portion 22N. The sheet is hold by the first nip portion 22N.

The second ejection roller pair 23 situated downstream of the first ejection roller pair 22 includes a driving roller 231, which is given a driving force by the conveyance drive source 26 (c.f. FIG. 11), and a driven roller 232, which is rotated along with the rotation of the driving roller 231. The circumferential surface of the driving roller 231 is in abutment with the circumferential surface of the driven roller 232 under a predetermined nip pressure to form a second nip portion 23N. The sheet is hold by the second nip portion 23N. The second nip portion 23N disappears during the sheet alignment process. The post-processing apparatus 2 includes a nip release mechanism 25 to release the second nip portion 23N. The nip release mechanism 25 includes an arm (not shown), which supports a roller shaft of the driven roller 232, and a gear mechanism and a drive source (a nip release driver 251 shown in FIG. 11) which swing the arm in the vertical direction. The nip release mechanism 25 may move the driven roller 232 up to release the second nip portion 23N. FIG. 2 shows the second ejection roller pair 23 in a condition that the second nip portion 23N is released.

A sheet conveyed by the first and second ejection roller pairs 22, 23 is subjected to an alignment process by the alignment unit 30. The structure and operation of the alignment unit 30 is described below.

The alignment unit 30 includes a process tray 32, a pair of alignment cursors 33, a reception plate 34 assembled into the process tray 32, a paddle unit 4 and a tapping unit 5 which are situated above the process tray 32. The alignment unit 30 further includes a first sheet sensor 35 and a second sheet sensor 36.

The process tray 32 of the alignment unit 30 is situated upstream of the ejection tray 24. The process tray 32 sequentially receives sheets to be subjected to the post-process. The process tray 32 includes a downstream end 321 situated at the highest position in the process tray 32 and an upstream end 322 situated upstream of the downstream end 321. The process tray 32 is inclined downward from the downstream end 321 to the upstream end 322. The downstream end 321 of the process tray 32 is near the second ejection roller pair 23 whereas the upstream end 322 of the process tray 32 is situated below the first ejection roller pair 22. In short, the process tray 32 is situated below the sheet conveyance path connecting the first and second nip portions 22N, 23N. The sheets are ejected onto the ejection tray 24 by the second ejection roller pair 23 in a condition that the second nip portion 23N is re-established, the sheet having been stored in the process tray 32 and subjected to the post-process.

The pair of alignment cursors 33 (c.f. FIGS. 3 and 4) aligned in the width direction of sheets which are stored in the process tray 32 abuts with the side edges of the sheets to correct skew of the sheets and perform an alignment operation to align the side edges of the sheets forming a sheet stack. The pair of alignment cursors 33 synchronously moves along a slot 37 in the process tray 32 so as to come closer to each other and depart from each other in the sheet width direction.

The reception plate 34 is attached to the upstream end 322 of the process tray 32 to receive sheets which have entered in a space between the pair of alignment cursors 33. In short, the reception plate 34 is attached to the lowest position in the inclined process tray 32. The reception plate 34 has a U-shaped cross-section as seen from the inclination direction of the process tray 32. The reception plate 34 has a U-shaped opening facing the downstream end 321. The reception plate 34 receives the upstream ends of sheets dropped along the inclined surface of the process tray 32. Therefore, the sheets sequentially sent into the process tray 32 are stacked at a predetermined position on the process tray 32. When the rear ends of the sheets abut with the reception plate 34 and then the pair of alignment cursors 33 abuts with the side edges of the sheets, the stapler 31 staples the sheets. With regard to the present embodiment, the post-processing portion is exemplified by the stapler 31.

The first sheet sensor 35 situated downstream of the first ejection roller pair 22 above the stapler 31 optically detects sheets. The first sheet sensor 35 detects that a conveyed sheet has passed through the first nip portion 22N along the conveyance path C. In short, the first sheet sensor 35 detects that the sheet have become a condition that the sheet can drop onto the process tray 32.

Like the first sheet sensor 35, the second sheet sensor 36 optically detects sheets. The second sheet sensor 36 is situated near the reception plate 34. The second sheet sensor 36 detects that the rear ends of the sheets received by the process tray 32 have been drawn to the reception plate 34. In short, the second sheet sensor 36 detects that the sheets have been drawn to the position at which the stapling process is performed.

The paddle unit 4 is used for sending a sheet to the position at which the stapling process is performed. The paddle unit 4 sends the sheet received by the process tray 32 toward the upstream end 322 of the process tray 32 and brings the rear end of the sheet into abutment with the reception plate 34. In short, the paddle unit 4 sequentially sends sheets in a drawing direction opposite to the conveyance direction, and draws the sheets to the predetermined position on the process tray 32, the sheet having conveyed to the downstream side along the conveyance path C in the conveyance direction. The paddle unit 4 includes a rotation shaft 41 and two paddle blades 42 attached to the rotation shaft 41. The two paddle blades 42 are attached to the rotation shaft 41 and situated near the middle of the rotation shaft 41 at intervals (c.f. FIG. 3).

The rotation shaft 41 extends straight in the sheet width direction. The rotation shaft 41 is distant upward from the process tray 32 by a predetermined distance. The rotation shaft 41 is rotated around the rotation shaft 41 by a first drive source 46. Thin-plate members extending from the rotation shaft 41 in the tangential direction of the circumferential surface of the rotation shaft 41 are used as the two paddle blades 42. When the rotation shaft 41 rotates, the two paddle blades 42 rotate along with the rotation shaft 41. Meanwhile, the distal ends of the two paddle blades 42 contact sheets on the process tray 32. Accordingly, the sheets are drawn toward the upstream end 322 of the process tray 32 by the rotation of the rotation shaft 41.

The rotation of the rotation shaft 41 is also used for driving the tapping unit 5. In response to the rotation of the rotation shaft 41, the tapping unit 5 taps the sheets around their rear ends to forcedly drop the sheets into the process tray 32, the sheets having passed through the first nip portion 22N. The tapping unit 5 includes two tapping members 50 which tap the sheets on the process tray 32 in a direction toward the process tray 32. The two tapping members 50 perform the tapping operation when the upstream ends of the sheets have passed through the first nip portion 22N. After the sheets dropping into the process tray 32, the tapping members 50 push the sheets on the process tray 32 to correct curling of the sheets. With regard to the present embodiment, the tapping portion is exemplified by the two tapping members 50.

The stapler 31 starts operating when the two tapping members 50 have dropped the last one of the sheets forming a sheet stack into the process tray 32. After the upstream end of the last sheet is drawn and brought into abutment with the reception plate 34, the stapler 31 staples the stacked sheets at a corner or edge of the stacked sheets.

(Details of Tapping Unit)

Figure 5:
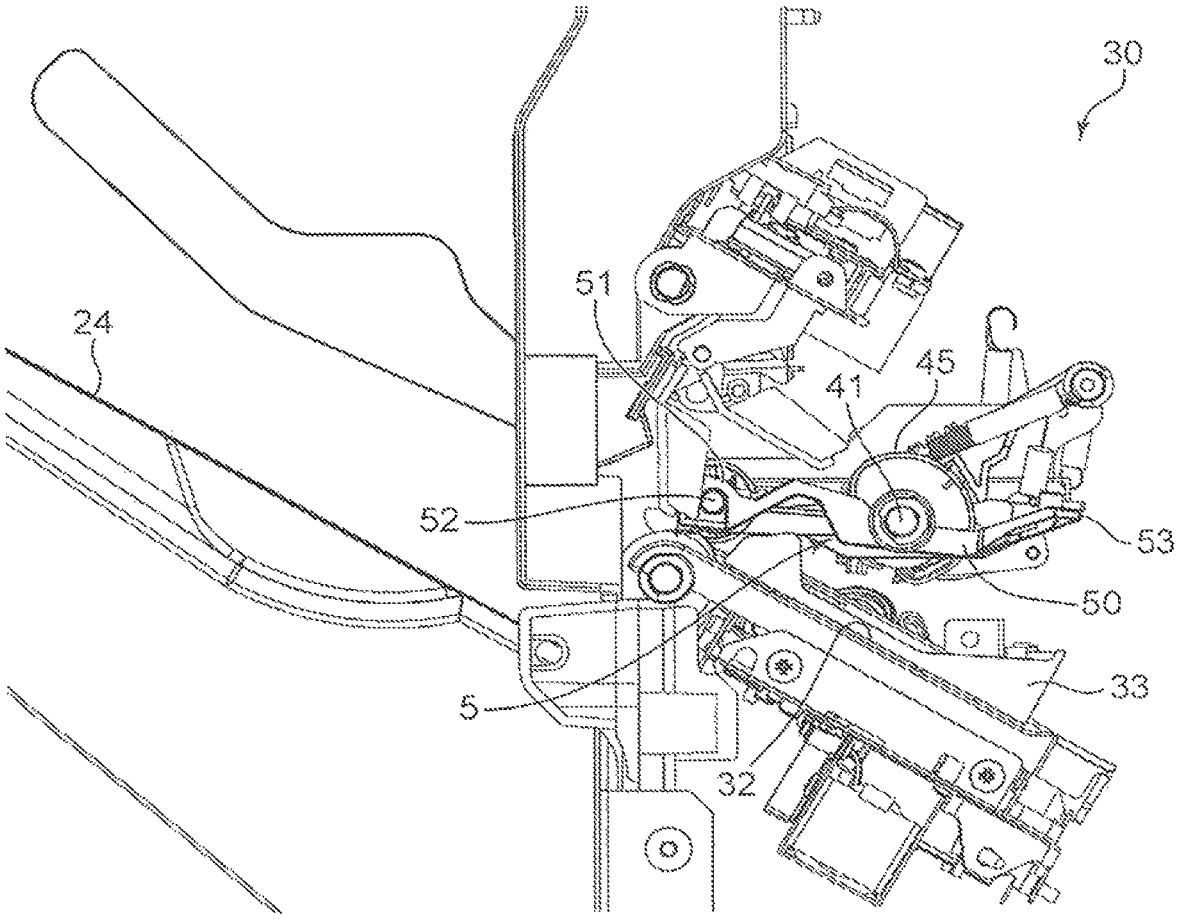
FIG. 5 is a side cross-sectional view of the alignment unit.

FIG. 5 is a side cross-sectional view of the alignment unit 30 shown in FIG. 4. In addition to the two tapping members 50, the tapping unit 5 has a swing shaft 52 to which the tapping members 50 are attached. Each of the tapping members 50 has a shape of a substantially rectangular flat plate. As shown in FIG. 3, the tapping members 50 are situated at positions in correspondence to the left and right end portions of the rotation shaft 41, respectively. Each of the tapping members 50 is adjacent to the outside of the paddle blade 42 as seen from the axial direction of the rotation shaft 41. Each of the tapping members 50 is large in the width direction to occupy an area from the end portion of the rotation shaft 41 to the position at which the paddle blade 42 is situated. The proximal end 51 of each of the tapping members 50 (a portion near the downstream end of the tapping member 50) is situated near the second ejection roller pair 23.

The swing shaft 52 is situated downstream of the rotation shaft 41. Like the rotation shaft 41, the swing shaft 52 extends in the width direction above the process tray 32. The proximal ends 51 of the two tapping members 50 are attached to the swing shaft 52. In short, the tapping members 50 are cantilevered by the left and right end portions of the swing shaft 52. Therefore, the tapping members 50 may swing around the swing shaft 52 (i.e. in the vertical direction). With regard to the present embodiment, the shaft member is exemplified by the swing shaft 52.

The swinging operation of the two tapping members 50 is caused by eccentric cams 45 attached to the rotation shaft 41. The rear surfaces of the tapping members 50 are in abutment with the circumferential surfaces of the eccentric cams 45 by a predetermined biasing force. When the eccentric cams 45 rotate under a rotation of the rotation shaft 41, large-diameter portions and small-diameter portions of the eccentric cams 45 alternately contact the tapping members 50. Therefore, the upstream ends of the tapping members 50 make one swing in the vertical direction around the swing shaft 52 when the eccentric cams 45 make one turn.

Under the rotation of the eccentric cams 45 around the rotation shaft 41, the orientation of the two tapping members 50 is changed between a tapping orientation in which the tapping members 50 approach the process tray 32 and a retracted orientation in which the tapping members 50 depart from the process tray 32. FIGS. 4 and 5 show the retracted orientation of the two tapping members 50. When the two tapping members 50 are in the retracted orientation, the small-diameter portions of the eccentric cams 45 contact the rear surfaces of the tapping members 50. Accordingly, the two tapping members 50 are rotated upward around the swing shaft 52 by the biasing force. Consequently, the distal ends 53 of the two tapping members 50 are moved up from the process tray 32. Meanwhile, the tapping members 50 do not inhibit the conveyance of the sheets from the first nip portion 22N to the second nip portion 23N (c.f. FIG. 2). The tapping orientation of the tapping members 50 is described below with reference to FIGS. 6 and 7.

Figure 6:
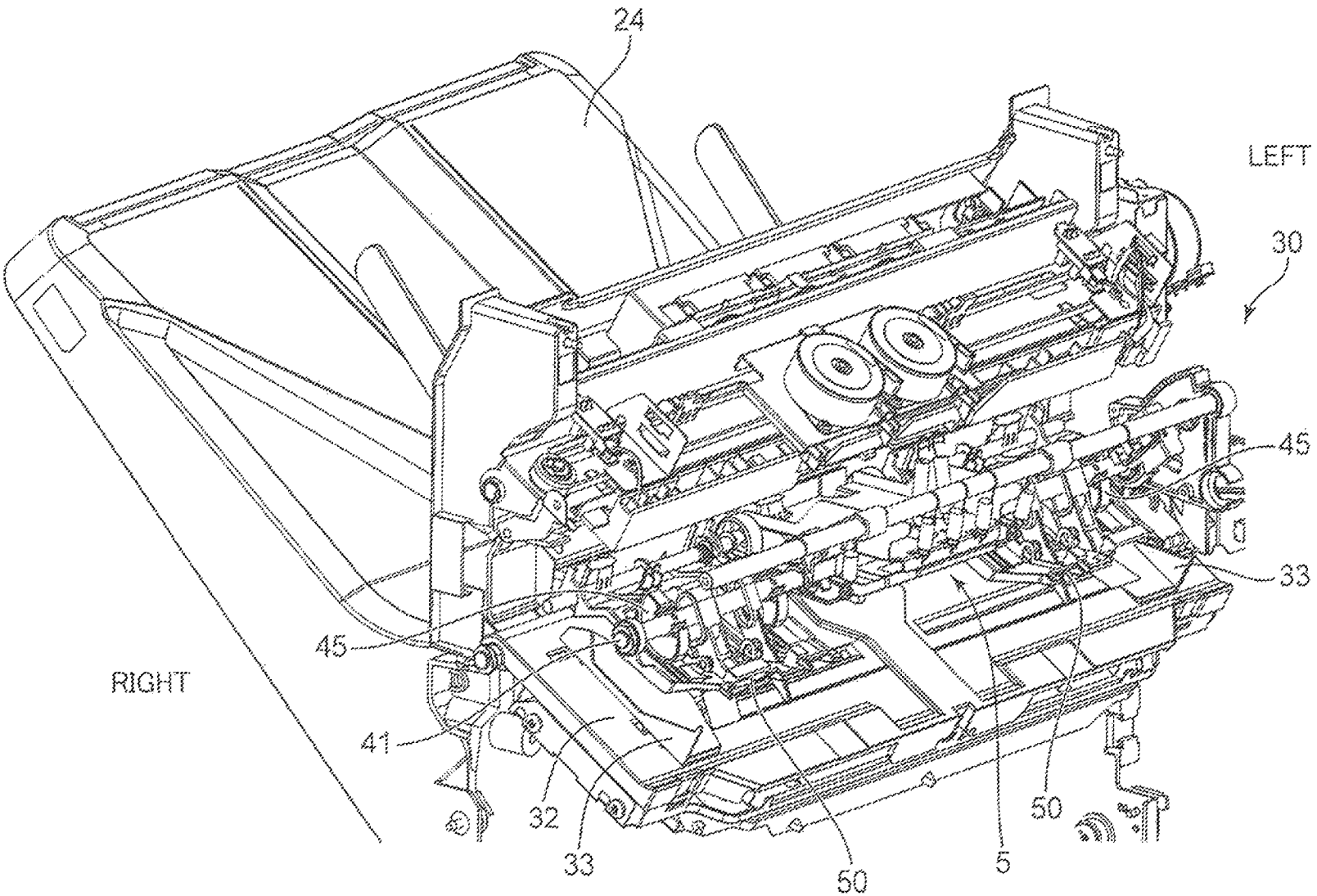
FIG. 6 is a perspective view of the alignment unit.
Figure 7:
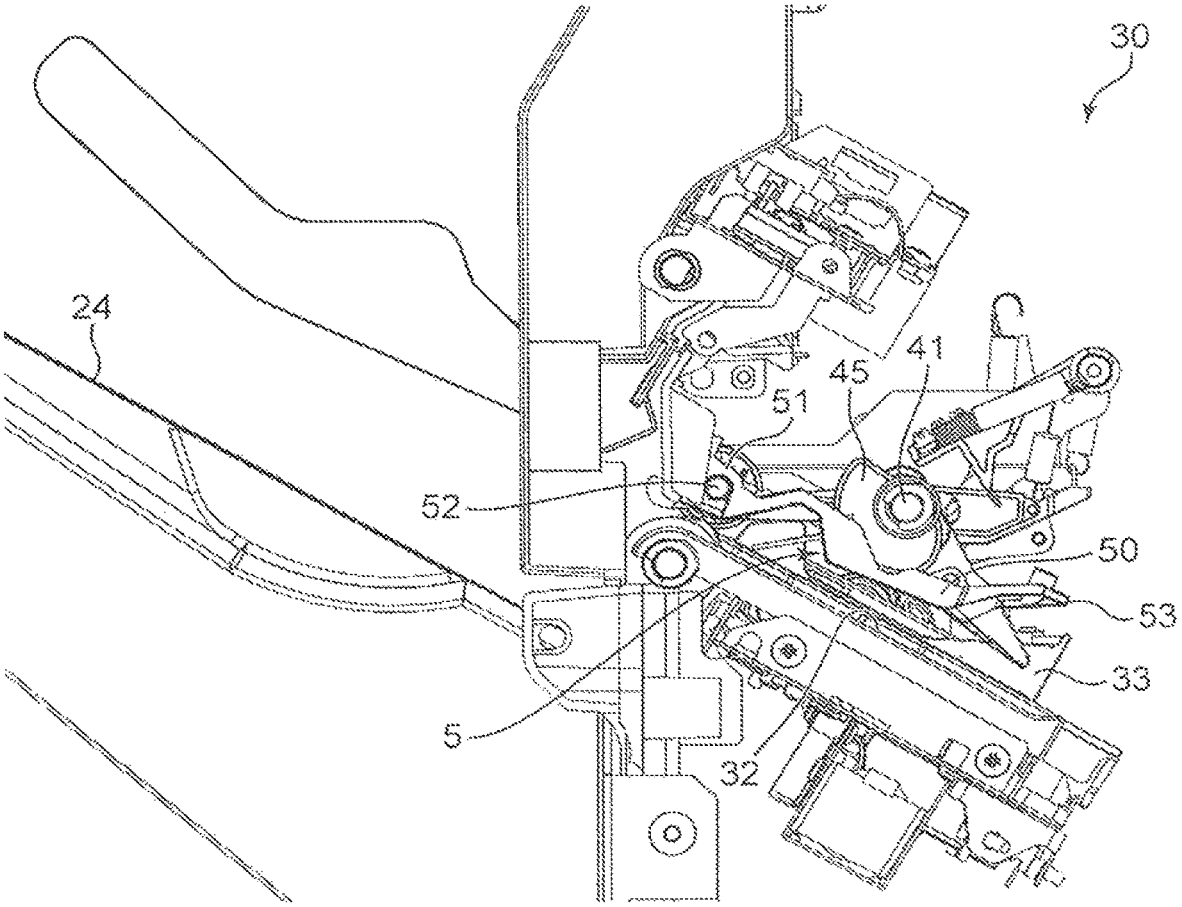
FIG. 7 is a side cross-sectional view of the alignment unit.

FIG. 6 is a perspective view of the alignment unit 30. FIG. 6 shows the two tapping members 50 in the tapping orientation. FIG. 7 is a side cross-sectional view of the alignment unit 30. When the two tapping members 50 are in the tapping orientation, the large-diameter portions of the eccentric cams 45 contact the rear surfaces of the tapping members 50 so that the tapping members 50 are pressed down against the biasing force. Therefore, the tapping members 50 rotate downward around the swing shaft 52 so that the distal ends 53 of the tapping members 50 approach the process tray 32. Accordingly, the tapping members 50 are inclined and become substantially parallel to the process tray 32.

The two tapping members 50 in the tapping orientation protrude to the sheet conveyance path from the first nip portion 22N to the second nip portion 23N. Therefore, the two tapping members 50 may tap the rear end of a sheet to drop the sheet into the process tray 32 when the orientation of the tapping members 50 is changed from the retracted orientation to the tapping orientation at the timing of the rear end of the sheet having passed through the first nip portion 22N. The two tapping members 50 in the tapping orientation are substantially parallel to the process tray 32 and are close to the process tray 32. Accordingly, if there is curling in the sheets having been dropped to the process tray 32, the tapping members 50 may press down the curled sheets to correct the curl.

(Operations of Post-Processing Apparatus)

Figure 8:
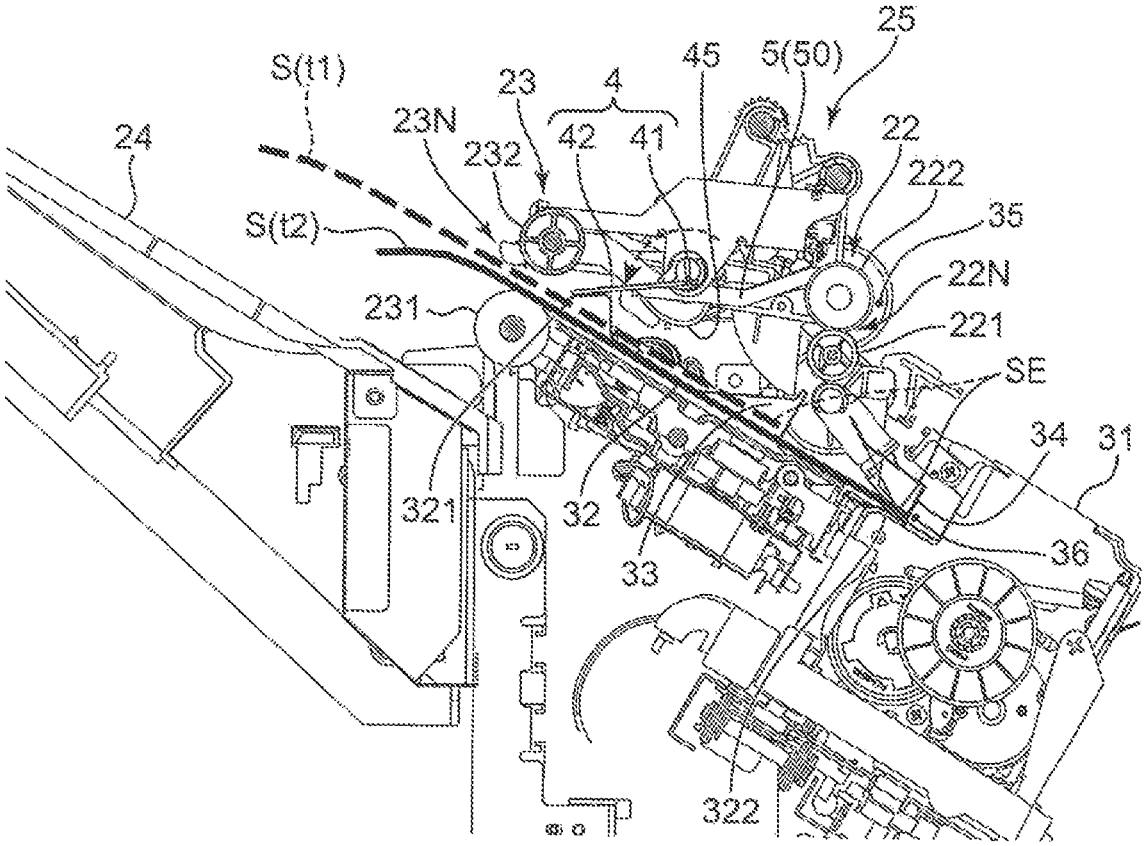
FIG. 8 is a schematic cross-sectional view of the post-processing apparatus.

FIG. 8 is a schematic cross-sectional view of the post-processing apparatus 2. An operation of drawing a sheet into the process tray 32 by the post-processing apparatus 2 is described with reference to FIG. 8. A sheet S after the image formation process is taken from the first housing 11 into the second housing 12 by the import roller pair 21 and sent to the conveyance path C (c.f. FIG. 1). Then, the sheet S is conveyed to the ejection tray 24 by the first and second ejection roller pairs 22, 23. Unless the sheet S is subjected to the post-process, the sheet S is ejected onto the ejection tray 24.

The drawing operation during the post-process on the sheet S is described below. When the sheet S is the first sheet among sheets forming a sheet stack (i.e. the first sheet sent from the first housing 11 to the second housing 12), the first and second ejection roller pairs 22, 23 convey the sheet S to the ejection tray 24. Meanwhile, the first sheet sensor 35 detects the sheet S. When the rear end SE of the sheet S has passed through the first nip portion 22N of the first ejection roller pair 22, the first sheet sensor 35 no longer detects the sheet S. At this time, the driven roller 231 of the second ejection roller pair 23 is rotated in the reverse direction. In synchronization with the reverse rotation of the driven roller 231, the tapping unit 5 is actuated to tap the sheet S. Accordingly, the sheet S drops into the process tray 32. The sheet S is then drawn into the process tray 32 by the second ejection roller pair 23. When the rear end SE of the sheet S has reached the reception plate 34, the driven roller 232 is moved upward under the operation of the nip release mechanism 25 to release the second nip portion 23N.

When the sheet S is a sheet after the first sheet, the nip release mechanism 25 releases the second nip portion 23N. After that, when the rear end SE of the sheet S has passed through the first nip portion 22N of the first ejection roller pair 22, the rotation shaft 41 is rotated by the first drive source 46. The tapping members 50 are pressed down by the eccentric cams 45 under the rotation of the rotation shaft 41 to tap the rear end SE of the sheet S downward. As a result of the aforementioned operations, the sheet S (t1) is dropped into the process tray 32 (c.f. the dotted line in FIG. 8). At this time, the rear end SE of the sheet S (t1) is distant from the reception plate 34.

The pair of alignment cursors 33 is then actuated. In short, the alignment cursors 33 are brought into abutment with the side edges of the sheet S (t1). Accordingly, skew of the sheet S (t1) is corrected. After that, the alignment cursors 33 are retracted and depart from the side edges of the sheet S (t1) whereas the paddle unit 4 draws the sheet S (t1) into the process tray 32. During the drawing operation into the process tray 32, the rotation shaft 41 is rotated so that the paddle blades 42 rotate around the rotation shaft 41 (rotate counterclockwise in FIG. 8). The paddle blades 42 contact and send the sheet S (t1) in the drawing direction opposite to the conveyance direction. Since the rotation shaft 41 rotates in the meantime, the tapping members 50 are swung by the eccentric cams 45. Accordingly, the curling in the sheet S (t1) is corrected. When the sheet S (t1) has a size which does not require the skew correction, the alignment cursors 33 may not perform the alignment operation during the drawing operation.

As the result of the drawing operation, the sheet S (t2) is conveyed until the rear end SE of the sheet S (t2) abuts with the reception plate 34 (c.f. the solid line in FIG. 8). When the rear end SE of the sheet S (t2) abuts with the reception plate 34, the stapler 31 may staple the sheet S (t2). The paddle blades 42 performing the drawing operation rotate for a predetermined period of time in accordance with a sheet size. Otherwise, the paddle blades 42 rotate until the second sheet sensor 36 detects that the rear end SE of the sheet S (t2) has reached the reception plate 34.

It is determined on the basis of the width of the sheet S whether the pair of alignment cursors 33 performs the alignment operation on the sheets S(t1) to S(t2) during the drawing operation and the tapping operation or the pair of alignment cursors 33 performs the alignment operation after the drawing operation. When the alignment cursors 33 do not interfere with the tapping members 50, the alignment cursors 33 and the tapping members 50 may be actuated at the same time. When the alignment cursors 33 interfere with the tapping members 50, the alignment cursors 33 may be actuated after the operation of the tapping members 50.

The aforementioned series of operations is performed on all sheets forming a sheet stack. For example, in order to perform the stapling process on ten sheets, the aforementioned tapping operation, drawing operation and alignment operation are performed in series on the second to tenth sheets S like the first sheet S. Meanwhile, the second nip portion 23N is released. When the ten sheets are stacked on the process tray 32, the stapler 31 staples the stack of the ten sheets. After that, the second nip portion 23N is re-established. When the driving roller 231 is driven, the stapled sheet stack is ejected onto the ejection tray 24.

(Relationship Between Width Alignment Cursors and Tapping Members)

As described above, the tapping members 50 perform not only the function of tapping the sheet S having just passed through the first nip portion 22N and dropping the sheet S into the process tray 32 but also the function of pressing down the sheet S toward the process tray 32 to correct the curling in the sheet. For example, when ink-jet image formation is performed on the sheet S in the first housing 11, the sheet S after the image formation is largely curled. In this case, it is preferable that the large tapping members 50 correct the curling. The tapping members 50 are extended from the outside of the paddle blade 42 to the vicinity of the end portion of the rotation shaft 41. However, the alignment cursors 33 may interfere with the tapping members 50 when the tapping members 50 are large.

Figure 9:
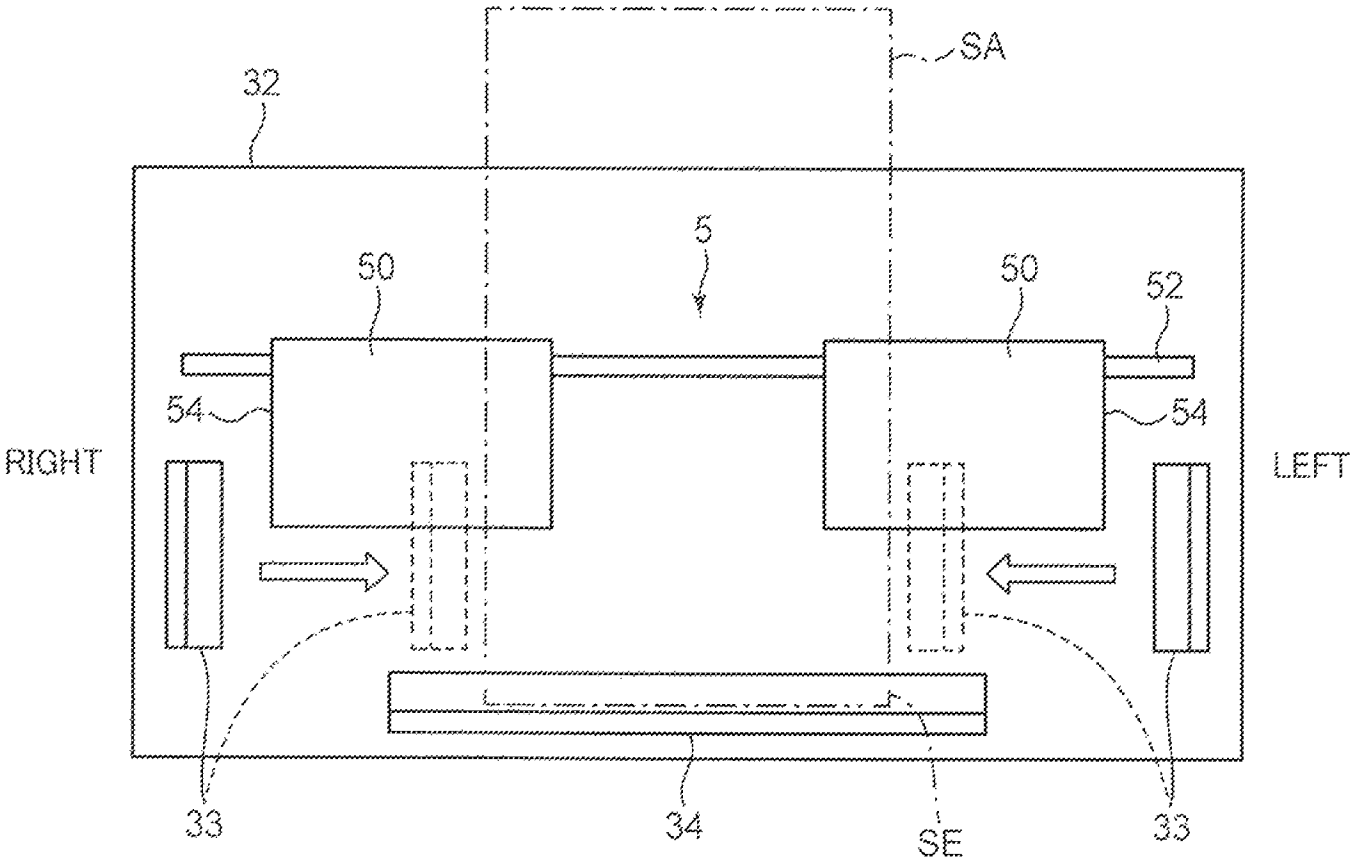
FIG. 9 is a schematic plane view of a process tray of the post-processing apparatus.

FIG. 9 is a schematic plane view of the process tray 32. An alignment operation performed on a small sheet SA to be subjected to the post-process is described with reference to FIG. 9. The sheet SA shown in FIG. 9 has a width about ⅓ the width of the process tray 32. The rear end SE of the sheet SA is in abutment with the reception plate 34. The two tapping members 50 of the tapping unit 5 vertically overlap the vicinity of the left and right edges of the sheet SA. When the tapping members 50 take the tapping orientation, the sheet SA is tapped by the tapping members 50.

The pair of alignment cursors 33 below the tapping members 50 moves so as to come close to each other and depart from each other in the width direction. When the tapping members 50 take the retracted orientation, the alignment cursors 33 are situated below the tapping members 50, so that the tapping members 50 and the alignment cursors 33 do not interfere with each other. When the tapping members 50 take the tapping orientation at the time of the alignment cursors 33 entering into the operating regions of the tapping members 50, the tapping members 50 and the alignment cursors 33 interfere with each other. In short, the operating range of the pair of alignment cursors 33 overlaps the operating range of the tapping members 50.

The alignment cursors 33 move so that the left and right alignment cursors 33, 33 abut respectively with the left and right edges of the small sheet SA. In the plane view, there is the left tapping member 50 above the motion line of the left alignment cursor 33 whereas there is the right tapping member 50 above the motion line of the right alignment cursor 33. Therefore, when the tapping members 50 rotate around the swing shaft 52 to take the tapping orientation, the tapping members 50 interfere with the left and right alignment cursors 33. Therefore, when the small sheet SA is placed on the process tray 32, the operation of tapping the sheet SA by the tapping members 50 is not performed at the same time as the alignment operation by the pair of alignment cursors 33.

Figure 10:
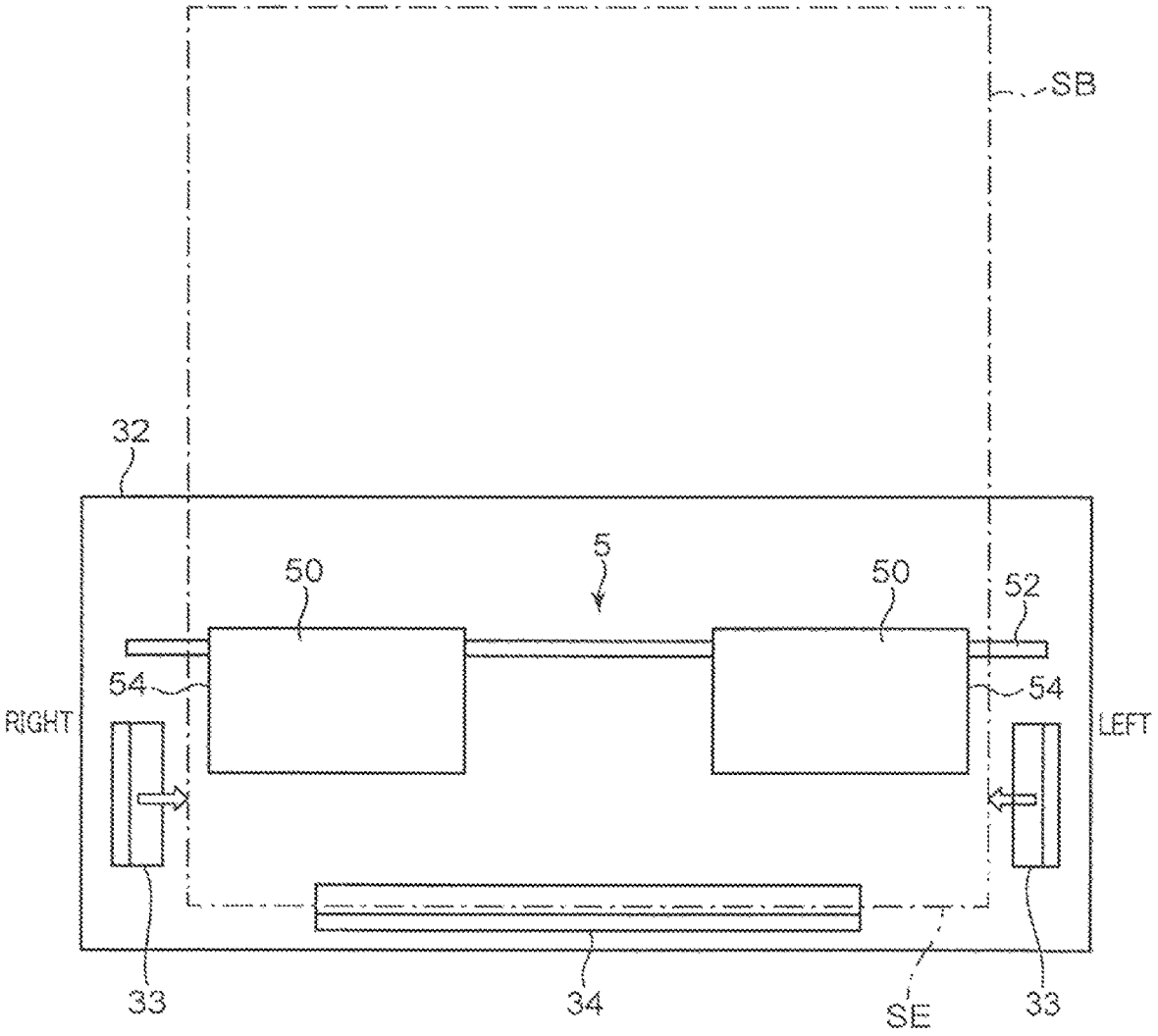
FIG. 10 is a schematic plane view of the process tray.

FIG. 10 is a schematic plane view of the process tray 32. An alignment operation on a large sheet SB to be subjected to the post-process is described with reference to FIG. 10.

The sheet SB shown in FIG. 10 is slightly smaller in width than the process tray 32. The rear end SE of the sheet SB is in abutment with the reception plate 34. The two tapping members 50 entirely overlap the vicinity of the left and right edges of the sheet SB in the vertical direction. When the tapping members 50 take the tapping orientation, the sheet SB is tapped by the tapping members 50. The left and right edges of the sheet SB are positioned outside side edges 54 of the tapping members 50 as seen from the width direction.

The alignment cursors 33 move so that the left and right alignment cursors 33 abut respectively with the left and right edges of the sheet SB. With regard to the large sheet SB, the tapping members 50 do not exist above the motion lines of the alignment cursors 33. Since the outer side edges 54 of the two tapping members 50 are positioned more inward than the left and right side edges of the sheet SB as seen from the width direction, the alignment cursors 33 do not reach the positions of the tapping members 50.

Therefore, even when the left and right tapping members 50 take the tapping orientation, the left and right alignment cursors 33 may perform the alignment operation without interference with the tapping members 50. In short, when the large sheet SB is placed on the process tray 32, the operation of tapping the sheet SB by the tapping members 50 may be performed at the same time as the alignment operation of the pair of alignment cursors 33. In this case, the post-processing apparatus 2 may perform the post-process efficiently.

The risk of the interference between the alignment cursors 33 and the tapping members 50 depends on a size of the sheet. Accordingly, the post-processing apparatus 2 is controlled on the basis of the size of the sheet S to be subjected to post-process so as to switch between the control mode, in which the tapping operation and the alignment operation are synchronously performed, and the control mode, in which these operations are sequentially performed. When the size of the sheet S is smaller in the width direction than a predetermined size (i.e. when the width of the sheet S is smaller than a distance between the side edges 54 of the left and right tapping members 50 (c.f. FIG. 9)), the alignment operation of the alignment cursors 33 is performed after the operation of tapping the sheet S by the tapping members 50 (first control). On the other hand, when the size of the sheet S in the width direction is no less than the predetermined size (i.e. when the width of the sheet S is larger than the distance between the side edges 54 of the left and right tapping members 50 (c.f. FIG. 10)), the tapping operation is performed at the same time as the alignment operation (second control).

(Electrical Configuration of Post-Processing Apparatus)

FIG. 11 is a block diagram showing an electrical configuration of the post-processing apparatus 2. The post-processing apparatus 2 includes a second drive source 47, the conveyance drive source 26, the nip release driver 251 and a controller 6 in addition to the first drive source 46, the stapler 31, the first and second sheet sensors 35, 36.

The first drive source 46 is a motor which drives the paddle unit 4 and the tapping unit 5 (the tapping members 50). The second drive source 47 is a motor which drives the pair of the alignment cursors 33 in the direction of coming closer to each other and the direction of departing from each other. The conveyance drive source 26 is a motor which rotationally drives the driving rollers 221, 231 of the first and second ejection roller pairs 22, 23. The nip release driver 251 is a drive source for operating the nip release mechanism 25 (i.e. the releasing operation and re-establishment operation of the second nip portion 23N).

The controller 6 includes a central processing unit (CPU) controlling operations of various components of the post-processing apparatus 2 (e.g. the first and second drive sources 46, 47), a read only memory (ROM) storing control programs and a random access memory (RAM) used as a working area for the CPU. The CPU of the controller 6 executes the control programs stored in the ROM. The controller 6 includes an alignment controller 61, a conveyance controller 65 and a nip release controller 66. The alignment controller 61, the conveyance controller 65 and the nip release controller 66 are described below.

The alignment controller 61 controls operations of various components of the alignment unit 30. The alignment unit 30 draws the sheet S into the process tray 32 or executes the alignment process under control of the alignment controller 61. The alignment controller 61 includes a drawing controller 62, a cursor controller 63 and a determination portion 64.

The drawing controller 62 controls the first drive source 46 which rotates the rotation shaft 41. Accordingly, the paddle unit 4 (the paddle blades 42) rotates under control of the drawing controller 62. The tapping members 50 of the tapping unit 5 swing and tap the sheet S under control of the drawing controller 62. The cursor controller 63 controls the second drive source 47 which rotates a pinion gear that moves the alignment cursors 33. Accordingly, the alignment cursors 33 perform the alignment operation on the sheet S under control of the cursor controller 63.

The determination portion 64 acquires attribute data including information about a size of the sheet S to be subjected to post-process from the first housing 11. On the basis of the attribute data, the determination portion 64 determines whether to perform the first control under which the tapping operation of the tapping members 50 is followed by the alignment operation of the alignment cursors 33 or the second control under which the tapping operation and the alignment operation are executed at the same time.

When the size of the sheet S is smaller than the predetermined size, the operating ranges of the tapping members 50 overlap the operating ranges of the alignment cursors 33. In short, the tapping members 50 interfere with the alignment cursors 33. In this case, the determination portion 64 determines that the first control is to be executed. On the other hand, when the size of the sheet S is no less than the predetermined size, the operating ranges of the tapping members 50 do not overlap the operating ranges of the alignment cursors 33. In short, the tapping members 50 do not interfere with the alignment cursors 33. The determination portion 64 determines that the second control is to be executed. When the first control is selected, the drawing controller 62 causes the tapping members 50 to take the tapping orientation. The drawing controller 62 then causes the tapping members 50 to change the tapping orientation to the retracted orientation. After the tapping members 50 take the retracted orientation, the cursor controller 63 causes the alignment cursors 33 to execute the alignment operation.

The conveyance controller 65 controls the conveyance drive source 26. Accordingly, the driving rollers 221, 231 of the first and second ejection roller pairs 22, 23 are rotated and stopped under control of the conveyance controller 65.

The nip release controller 66 controls the driving of the nip release driver 251 so that the second nip portion 23N is released and re-established at predetermined timings. For example, the nip release controller 66 actuates the nip release mechanism 25 to release the second nip portion 23N after the first sheet S has been drawn into the process tray 32 when a sheet stack of a predetermined number of stacked sheets S is stapled. After all the subsequent sheets S are sequentially drawn into the process tray 32 and then the sheets S stacked on the process tray 32 are stapled, the nip release controller 66 re-establishes the second nip portion 23N to eject the sheet stack from the process tray 32 onto the ejection tray 24.

(Operation Flow of Post-Processing Apparatus)

Figure 12:
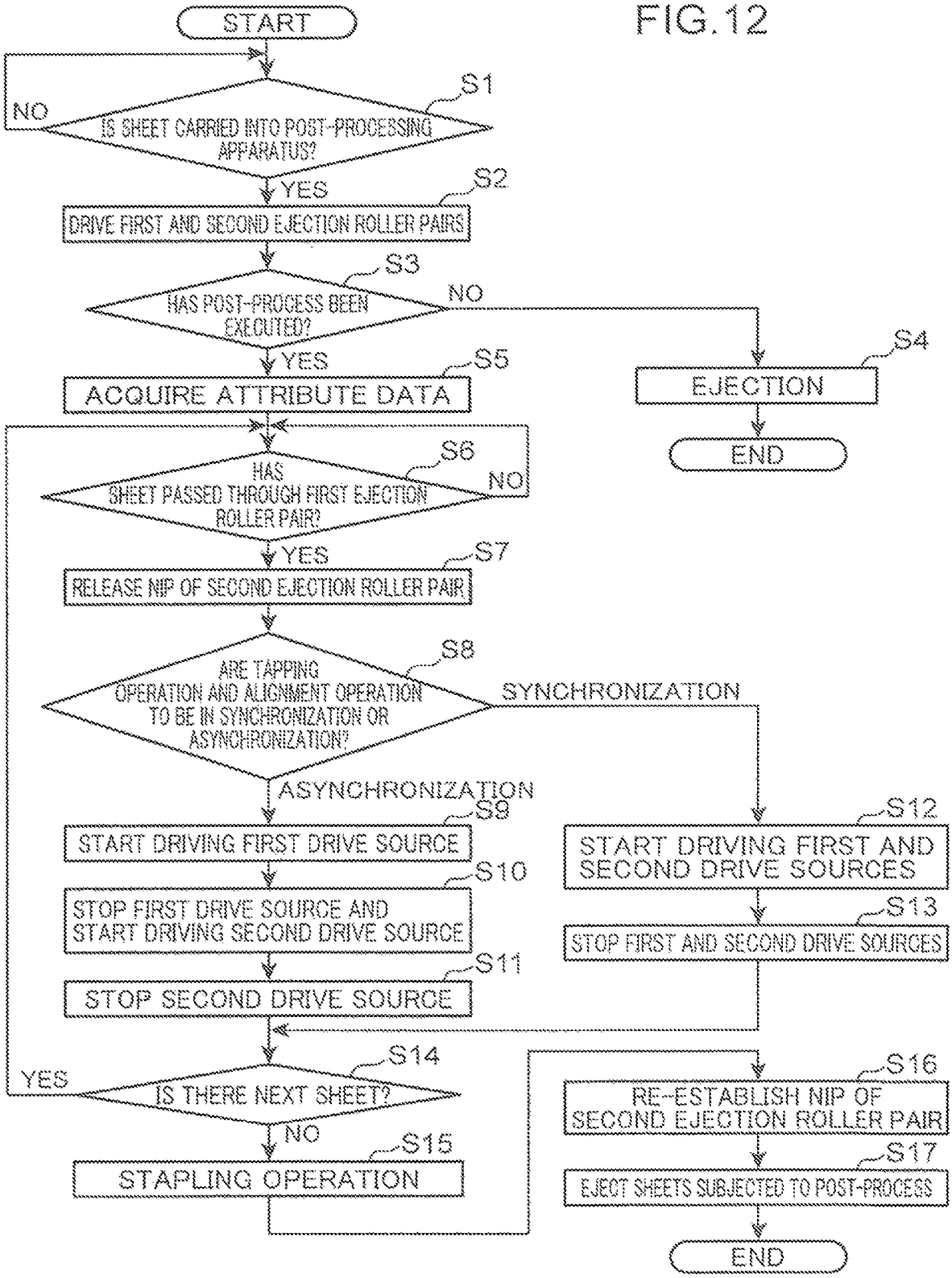
FIG. 12 is a flowchart showing operations of the post-processing apparatus.

An exemplificative stapling process executed by the post-processing apparatus 2 is described with reference to the flowchart of FIG. 12. The flowchart of FIG. 12 mainly describes the tapping operation of the tapping members 50 and the alignment operation of the alignment cursors 33. The flowchart of FIG. 12 does not describe other operations of the alignment unit 30 in detail.

The controller 6 determines whether there is a sheet ejection instruction for indicating that the sheet S is carried into the post-processing apparatus 2 (step S1). When there is no sheet ejection instruction (NO in step S1), the controller 6 becomes standby. When there is the sheet ejection instruction (YES in step S1), the conveyance controller 65 starts the operation of the conveyance drive source 26 at a predetermined timing. Accordingly, the sheet S is passed from the first housing 11 into the second housing 12, and then is conveyed along the conveyance path C by the import roller pair 21, the first and second ejection roller pairs 22, 23 rotated by the conveyance drive source 26.

The controller 6 determines whether the sheet ejection instruction includes an instruction for execution of the post-process (stapling process) (step S3). When the sheet ejection instruction includes no instruction for the execution of the post-process (NO in step S3), the controller 6 causes the first and second ejection roller pairs 22, 23 to continue the conveyance of the sheet S and eject the sheet S onto the ejection tray 24 (step S4).

When the sheet ejection instruction includes the instruction for the execution of the post-process (YES in step S3), the determination portion 64 acquires the attribute data including information about a size of the sheet S from the first housing 11 (step S5). At this time, an operating period of the paddle unit 4 (i.e. a period of rotation of the rotation shaft 41 by the first drive source 46) is set on the basis of the attribute data.

The conveyance controller 65 then determines whether the rear end SE of the sheet S has passed through the first nip portion 22N of the first ejection roller pair 22 on the basis of a detection result from the first sheet sensor 35 (step S6). When the passage of the rear end SE of the sheet S is not detected (NO in step S6), the first and second ejection roller pairs 22, 23 continue the rotation. On the other hand, when the passage of the rear end SE of the sheet S is detected (YES in step S6), the conveyance controller 65 rotationally drives the second ejection roller pair 23 in the reverse direction if the sheet S is the first one of sheets to be subjected to the post-process. At this time, the drawing controller 62 drives the first drive source 46 so that the tapping unit 5 taps the rear end SE of the sheet S. The second ejection roller pair 23 is then rotated in the reverse direction to draw the sheet S into the process tray 32. The nip release controller 66 then causes the nip release mechanism 25 to release the second nip portion 23N of the second ejection roller pair 23 (step S7). When the sheet S is a subsequent sheet sent after the first sheet, the second nip portion 23N is released from the beginning.

On the basis of the attribute data, the determination portion 64 then determines whether the tapping members 50 and the alignment cursors 33 synchronously execute the tapping operation of the tapping members 50 and the alignment operation of the alignment cursors 33 (second control) or asynchronously execute these operations (first control) (step S8). When the sheet S to be subjected to the post-process is the small sheet SA (c.f. FIG. 9), the tapping members 50 interfere with the alignment cursors 33. Therefore, the determination portion 64 determines that these operations should be asynchronously performed.

In this case, the drawing controller 62 starts driving the first drive source 46 to rotate the rotation shaft 41 of the paddle unit 4 (step S9). Accordingly, the tapping members 50 tap the rear end SE of the sheet S to drop the sheet S into the process tray 32. Meanwhile, the paddle blades 42 of the paddle unit 4 draw the sheet S into the process tray 32. While the first drive source 46 continues the driving, the paddle unit 4 draws the sheet S and the tapping unit 5 presses the sheet S to correct curling in the sheet S. After the first tapping operation of the tapping members 50, the rotation of the rotation shaft 41 may be stopped temporarily. While the rotation of the rotation shaft 41 is stopped, the pair of alignment cursors 33 may correct skew of the sheet S. After that, the rotation of the rotation shaft 41 may be restarted to execute the drawing operation and the tapping operation.

The drawing controller 62 then stops the first drive source 46 at the timing when the second sheet sensor 36 detects arrival of the rear end SE of the sheet S at the reception plate 34 or at the timing when a preset rotation period of the rotation shaft 41 has elapsed. At the same time, the cursor controller 63 starts driving the second drive source 47 and causes the alignment cursors 33 to execute the alignment operation on the sheet S drawn into the process tray 32 (step S10). Upon completion of the alignment operation on the sheet S, the cursor controller 63 stops the second drive source 47 (step S11).

When the sheet S to be subjected to the post-process is the large sheet SB (c.f. FIG. 10), the tapping members 50 do not interfere with the alignment cursors 33. In this case, the determination portion 64 determines in step S8 that the operations should be synchronously performed. In response to the determination of the concurrent execution, the drawing controller 62 starts driving the first drive source 46 and the cursor controller 63 starts driving the second drive source 47 (step S12). The drawing controller 62 and the cursor controller 63 then stop the first and second drive sources 46, 47 at predetermined timings. The first and second drive sources 46, 47 may not be stopped at the same time. For example, only the first drive source 46 may be stopped at the timing when the second sheet sensor 36 detects the rear end SE of the sheet S.

After step S11 or S13, it is determined whether all the sheets S to be subjected to the post-process are stored in the process tray 32 (i.e. whether there is the next sheet to be drawn into the process tray 32) (step S14). When there is the next sheet (YES in step S14), the driving roller 221 is driven to execute step S6 again.

When there is no next sheet (NO in step S14), the controller 6 actuates the stapler 31 so that the stapler 31 executes the stapling process to staple the sheet stack aligned on the process tray 32 (step S15). After the stapling process, the nip release controller 66 re-establishes the second nip portion 23N (step S16). The conveyance controller 65 then drives the driving roller 231 of the second ejection roller pair 23 so that the second ejection roller pair 23 ejects the stapled sheet stack onto the ejection tray 24 (step S17).

As described above, the timings for executing the tapping operation and the alignment operation are changed on the basis of a size of the sheet S to be subjected to the post-process. When the small sheet SA is sent to the post-processing apparatus 2, the moving ranges of the alignment cursors 33 become wider in the width direction so that the alignment cursors 33 interfere with the tapping members 50. In this case, the controller 6 performs the first control to make a timing for the tapping operation of the tapping members 50 different from a timing for the alignment operation of the alignment cursors 33. This prevents the interference between the tapping members 50 and the alignment cursors 33. On the other hand, when the large sheet SB is sent to the post-processing apparatus 2, the moving ranges of the alignment cursors 33 becomes narrower in the width direction so that the alignment cursors 33 do not interfere with the tapping members 50. In this case, the controller 6 performs the second control to synchronize the tapping operation with the alignment operation. Accordingly, the post-process is efficiently performed.

(Correction of Curling on Ejection Tray)

As described above, curling in the sheet on the process tray 32 is corrected by the tapping operation. In addition to the tapping unit 5 performing the tapping operation, the post-processing apparatus 2 has a mechanism for correcting curling in the sheet on the ejection tray 24. The mechanism for correcting curling in the sheet on the ejection tray 24 is described below.

Figure 13:
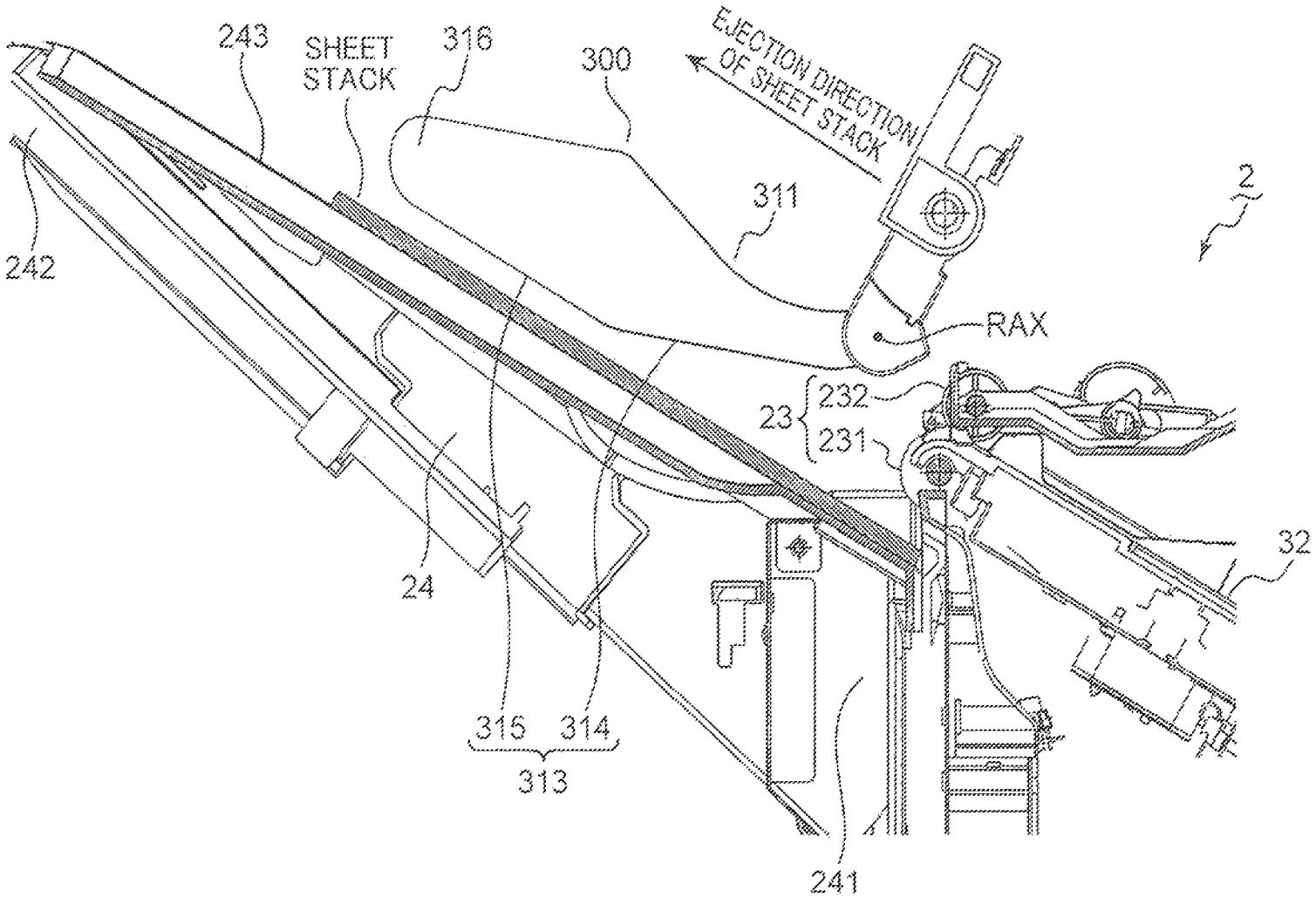
FIG. 13 is a schematic cross-sectional view of a part of the post-processing apparatus.

FIG. 13 is a schematic cross-sectional view of a part of the exemplificative post-processing apparatus 2. The post-processing apparatus 2 is described with reference to FIG. 13. Before the mechanism for correcting curling in the sheet on the ejection tray 24, a schematic structure around the ejection tray 24 is described.

The ejection tray 24 includes a proximal end 241 and a distal end 242. The proximal end 241 is situated below the second ejection roller pair 23. The distal end 242 is situated downstream of the proximal end 241 and at a higher position than the proximal end 241. Therefore, an inclined surface 243 is formed between the proximal and distal ends 241, 242. The sheet stack ejected from the process tray 32 by the second ejection roller pair 23 drops onto the inclined surface 243.

Figure 14:
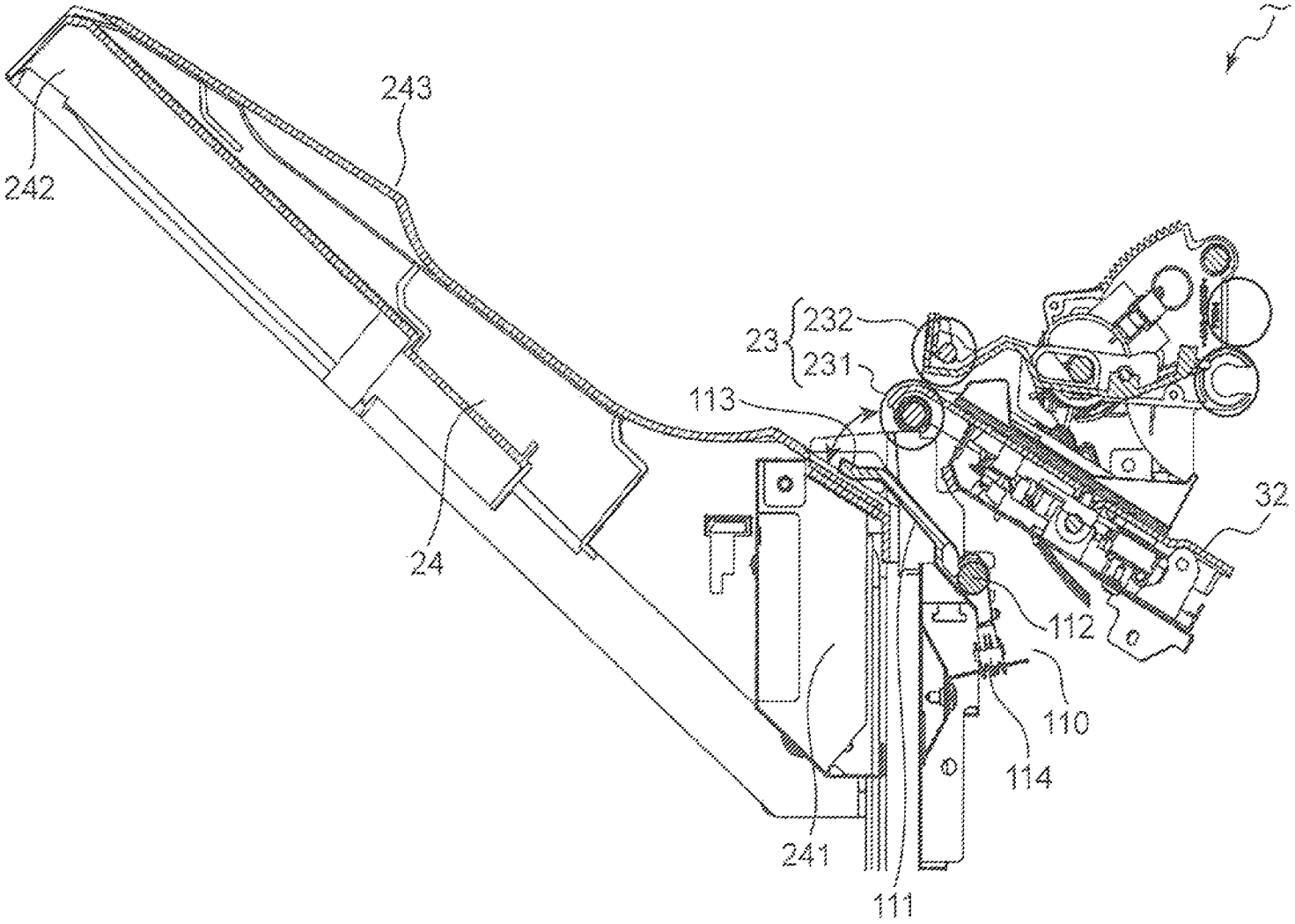
FIG. 14 is a schematic cross-sectional view of the post-processing apparatus.

FIG. 14 is another schematic cross-sectional view of the post-processing apparatus 2. The post-processing apparatus 2 is further described with reference to FIGS. 13 and 14.

As shown in FIG. 14, the post-processing apparatus 2 further includes a press mechanism 110 which presses the upstream end of the sheet stack against the proximal end 241 of the ejection tray 24. The press mechanism 110 includes a press arm 111, a rotation shaft 112 and a press driver (not shown). The press arm 111 includes a distal end 113 and a proximal end 114 opposite to the distal end 113. The distal end 113 may move vertically in a space between the driving roller 231 of the second ejection roller pair 23 and the proximal end 241 of the ejection tray 24. The proximal end 114 may be used for detection of an orientation of the press arm 111. The rotation shaft 112 is coupled to the press arm 111 between the proximal and distal ends 114, 113. The rotation shaft 112 is rotated by the press driver within a predetermined angular range. Accordingly, the press arm 111 swings around the rotation shaft 112, so that the distal end 113 of the press arm 111 may move vertically as described above. The press driver may be a solenoid switch, a stepping motor or another actuator which causes the press arm 111 to swing within a predetermined angular range. The principles of the present embodiment are not limited to a specific device used as the press driver.

When the second ejection roller pair 23 ejects a sheet stack onto the ejection tray 24, the press driver causes the press arm 111 to swing so that the distal end 113 of the press arm 111 moves upward. Accordingly, a space is formed below the distal end 113 of the press arm 111. The upstream end of the sheet stack moving toward the proximal end 241 of the ejection tray 24 along the inclination of the inclined surface 243 enters into the space formed below the distal end 113 of the press arm 111. After that, the press arm 111 swings so that the distal end 113 of the press arm 111 moves down. The distal end 113 of the press arm 111 abuts with the upstream end of the sheet stack, which contributes to preventing the sheet stack from curling near the upstream end of the sheet stack.

Unlike the upstream end of the sheet stack, the downstream end of the sheet stack is not restrained by the press mechanism 110 but is more likely to be curled than the upstream end of the sheet stack. The post-processing apparatus 2 has a curl prevention portion 300 to prevent curling caused near the downstream end of the sheet stack. The problem of curling caused near the downstream end of the sheet stack is briefly described below.

When the sheet stack on the ejection tray 24 is thin, the upper surface of the sheet stack is substantially parallel to the inclined surface 243 of the ejection tray 24. When the second ejection roller pair 23 ejects sheet stacks onto the ejection tray 24, the sheet stacks on the ejection tray 24 increase in thickness. The present inventors have found a problem that the sheet stacks curl more largely near the downstream end of the sheet stacks as the sheet stacks on the ejection tray 24 becomes thicker. The change in curling state of the sheet stack on the ejection tray 24 may result in an excessively high friction force between a member for preventing curling and the sheet stacks. The excessively high friction force may inhibit the ejection of the sheet stack onto the ejection tray 24. Accordingly, the present inventors have developed the curl prevention portion 300 so that there is no excessively high friction force between the curl prevention portion 300 and the sheet stack.

As shown in FIG. 13, the curl prevention portion 300 includes a tray cursor 311 extended over the ejection tray 24. The tray cursor 311 is a thin plate-shaped member that is elongated in the ejection direction of the sheet stack. The tray cursor 311 includes a lower edge 313 which faces the inclined surface 243 of the ejection tray 24 or the upper surface of the sheet stack on the ejection tray 24.

FIG. 13 shows conceptually a rotation axis RAX of the tray cursor 311. The tray cursor 311 swings around the rotation axis RAX. With regard to the present embodiment, the rotation axis RAX is set to intersect the proximal end (not shown) of the tray cursor 311. However, the rotation axis RAX may be set to intersect another portion of the tray cursor 311.

The lower edge 313 of the tray cursor 311 includes a proximal end 314 extending in the ejection direction of the sheet stack from the proximal end, at which the rotation axis RAX is set, and an abutment edge 315 which mainly contacts the upper surface of the sheet stack on the ejection tray 24. The abutment edge 315 applies a downward force to the sheet stack so that the sheet stack is pressed against the ejection tray 24. Accordingly, the curl prevention portion 300 may prevent the sheet stack on the ejection tray 24 from curling. With regard to the present embodiment, the first tray cursor is exemplified by the tray cursor 311.

The curl prevention portion 300 further includes an angle changer (not shown) which swings the tray cursor 311 around the rotation axis RAX to change the inclination angle of the tray cursor 311 with respect to the ejection tray 24. The inclination angle of the tray cursor 311 with respect to the ejection tray 24 may be defined as a difference between the inclination angle of the abutment edge 315 with respect to a virtual horizontal plane and the inclination angle of the inclined surface 243 with respect to a virtual horizontal plane. Alternatively, any other definition may be given to the inclination angle of the tray cursor 311 with respect to the ejection tray 24. The principles of the present embodiment are not limited to a specific definition of the inclination angle of the tray cursor 311 with respect to the ejection tray 24.

The angle changer may be a motor having a rotation shaft coaxial with the rotation axis RAX. Alternatively, the angle changer may include a motor, which is situated at a distant position from the rotation axis RAX, a rotation shaft, which is coaxial with the rotation axis RAX, and a belt, which transfers power from the motor to the rotation shaft. The principles of the present embodiment are not limited to a specific structure of the angle changer.

As shown in FIG. 13, the angle changer sets a rotation position of the tray cursor 311 so that the inclination angle of the abutment edge 315 with respect to the ejection tray 24 is substantially 0° (i.e. the abutment edge 315 becomes substantially parallel to the inclined surface 243) when the sheet stack on the ejection tray 24 is thin (i.e. when a small number of sheets is placed on the ejection tray 24).

The tray cursor 311 includes a distal end 316 which is distant in the ejection direction of a sheet stack from the proximal end at which the rotation axis RAX is set. To move the distal end 316 upward, the angle changer causes the tray cursor 311 to swing around the rotation axis RAX in accordance with an increase in sheets on the ejection tray 24. Accordingly, the relationship between the tray cursor 311 and the ejection tray 24 changes from the state in which the abutment edge 315 is substantially parallel to the inclined surface 243 to the state in which the abutment edge 315 is inclined with respect to the inclined surface 243.

As described above, when a larger number of sheets is placed on the ejection tray 24, the downstream end of the sheet stack is likely to curve more upward. This means that the tray cursor 311 is likely to abut strongly the upper surface of the sheet stack on the ejection tray 24. However, the angle changer causes the tray cursor 311 to swing so that the distal end 316 of the tray cursor 311 departs upward from the ejection tray 24 (i.e. the inclination angle of the tray cursor 311 increases with respect to the ejection tray 24), which results in no excessively large friction force between the tray cursor 311 and the sheet stack.

<Other Features>

A designer may provide various features to the post-processing apparatus 2. The following features do not limit the principles of the post-processing apparatus 2 described in the context of the aforementioned embodiment in any way.

(Detection of Quantity of Sheets on Ejection Tray)

As described above, the inclination angle of the tray cursor 311 with respect to the ejection tray 24 is changed in accordance with a quantity of sheets on the ejection tray 24. The quantity of sheets on the ejection tray 24 may be determined on the basis of information received from the image formation apparatus or signals from various sensors (e.g. the first sheet sensor 35) arranged in the post-processing apparatus 2. However, the inclination angle of the tray cursor 311 with respect to the ejection tray 24 does not have to be adjusted for each sheet sent onto the ejection tray 24. Therefore, a simpler technique may be used than the aforementioned determination techniques. The technique for simple adjustment to the inclination angle of the tray cursor 311 with respect to the ejection tray 24 is described below.

Figure 15:
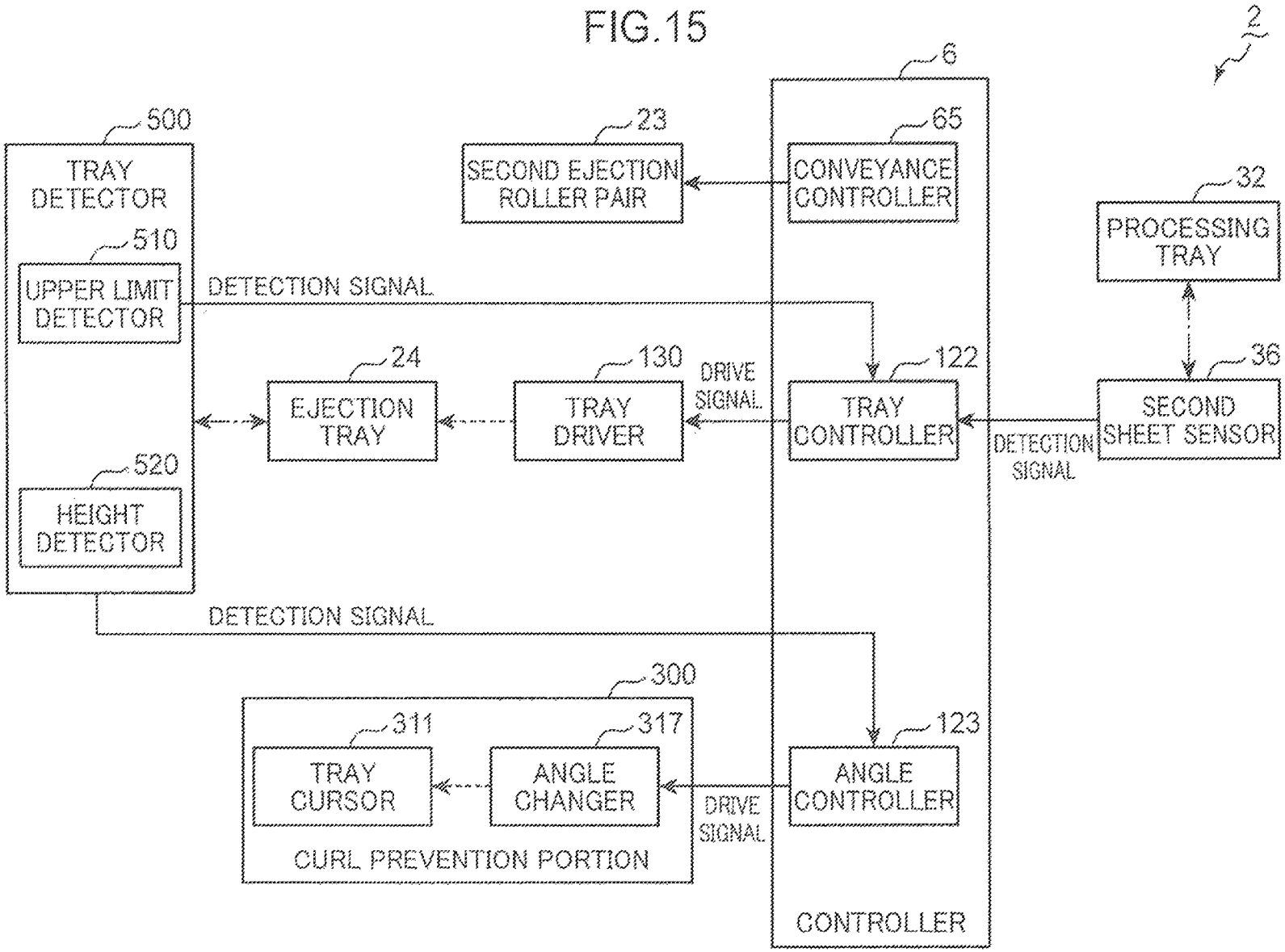
FIG. 15 is a schematic block diagram of an exemplificative functional configuration of the post-processing apparatus.

FIG. 15 is a schematic block diagram of an exemplificative functional configuration of the post-processing apparatus 2 for adjusting the inclination angle of the tray cursor 311. The functional configuration of the post-processing apparatus 2 is described with reference to FIGS. 11, 13 and 15. Solid lines in FIG. 15 conceptually represent transfer of signals. Dotted lines in FIG. 15 conceptually represent transfer of force. Chain lines in FIG. 15 conceptually represents a detection operation.

The post-processing apparatus 2 further includes a tray driver 130 and a tray detector 500. The tray driver 130 and the curl prevention portion 300 are controlled by the controller 6, like the second ejection roller pair 23.

The controller 6 receives a detection signal from the second sheet sensor 36, the detection signal representing the presence or absence of a sheet stack on the process tray 32. The controller 6 includes a tray controller 122 and an angle controller 123 in addition to the alignment controller 61, the conveyance controller 65 and the nip release controller 66 (c.f. FIG. 11).

The tray controller 122 controls the tray driver 130 in response to the detection signal output from the second sheet sensor 36. A voltage of the detection signal from the second sheet sensor 36 changes when the second ejection roller pair 23 starts to eject a sheet stack from the process tray 32 under control of the conveyance controller 65. Upon receipt of the detection signal from the second sheet sensor 36, the tray controller 122 controls the tray driver 130 in response to the change in voltage of the detection signal. When the change in voltage of the detection signal indicates a change in state from the presence of the sheet stack on the process tray 32 to the absence of the sheet stack on the process tray 32, the tray controller 122 controls the tray driver 130 to move the ejection tray 24 down by a predetermined amount.

The tray driver 130 may include a motor and a conversion mechanism (e.g. a combination of a belt and a pulley) which converts a rotation of the motor into a vertical movement of the ejection tray 24. Various mechanisms for use in known post-processing apparatuses are applicable to the tray driver 130. Therefore, the principles of the present embodiment are not limited to a specific structure of the tray driver 130.

The tray controller 122 switches the movement direction of the ejection tray 24 on the basis of a period of time elapsed from the start of the downward movement of the ejection tray 24. When the period of time elapsed from the start of the downward movement of the ejection tray 24 exceeds a predetermined value, the tray controller 122 controls the tray driver 130 to move the ejection tray 24 up.

The tray detector 500 includes an upper limit detector 510 and a height detector 520. The upper limit detector 510 may be an optical reflective sensor which forms a detection region above the height detector 520. The height detector 520 may be optical reflective sensors which forms detection regions at different heights.

As described above, when the second ejection roller pair 23 ejects a sheet stack onto the ejection tray 24, the tray driver 130 moves down and then moves up the ejection tray 24 under control of the tray controller 122. When the upper surface of the sheet stack on the ejection tray 24 enters the detection region of the upper limit detector 510, a voltage change happens to the detection signal output from the upper limit detector 510. The detection signal is output from the upper limit detector 510 to the tray controller 122. When the voltage change happens to the detection signal output from the upper limit detector 510, the tray controller 122 stops generating a drive signal for driving the tray driver 130. Accordingly, the upward movement of the ejection tray 24 is stopped.

Since the position of the detection region of the upper limit detector 510 remains constant, the height of the upper surface of the sheet stack on the ejection tray 24 remains also substantially constant when the upward movement of the ejection tray 24 is stopped. Therefore, when the sheet stack on the ejection tray 24 is thin (i.e. a small number of sheets is placed on the ejection tray 24), the ejection tray 24 is stopped at a high position. On the other hand, when the sheet stack on the ejection tray 24 is thick (i.e. a large number of sheets is placed on the ejection tray 24), the ejection tray 24 is stopped at a low position. The height detector 520 generates a detection signal representing a change in height of the ejection tray 24 in accordance with the sheet stack on the ejection tray 24.

The detection signals generated by the upper limit detector 510 and the height detector 520 are output to the angle controller 123. The angle controller 123 may determine whether to stop the ejection tray 24 with reference to the detection signal from the upper limit detector 510. The angle controller 123 may then determine a height of the ejection tray 24 with reference to the detection signal from the height detector 520. The angle controller 123 determines the inclination angle of the tray cursor 311 on the basis of the height of the ejection tray 24. The angle controller 123 generates a drive signal to obtain the determined inclination angle. The drive signal is output from the angle controller 123 to the angle changer 317. The angle changer 317 causes the tray cursor 311 to swing around the rotation axis RAX in response to the drive signal. Accordingly, an appropriate angle of the tray cursor 311 is obtained with respect to the ejection tray 24. In short, when the sheet stack on the ejection tray 24 is thin, the inclination angle of the tray cursor 311 is set so that the abutment edge 315 of the tray cursor 311 becomes substantially parallel to the inclined surface 243 of the ejection tray 24. When the sheet stack on the ejection tray 24 is thick, the tray cursor 311 swings around the rotation axis RAX so that the distal end 316 of the tray cursor 311 moves up from the position at which the abutment edge 315 of the tray cursor 311 is substantially parallel to the inclined surface 243 of the ejection tray 24.

Figure 16:
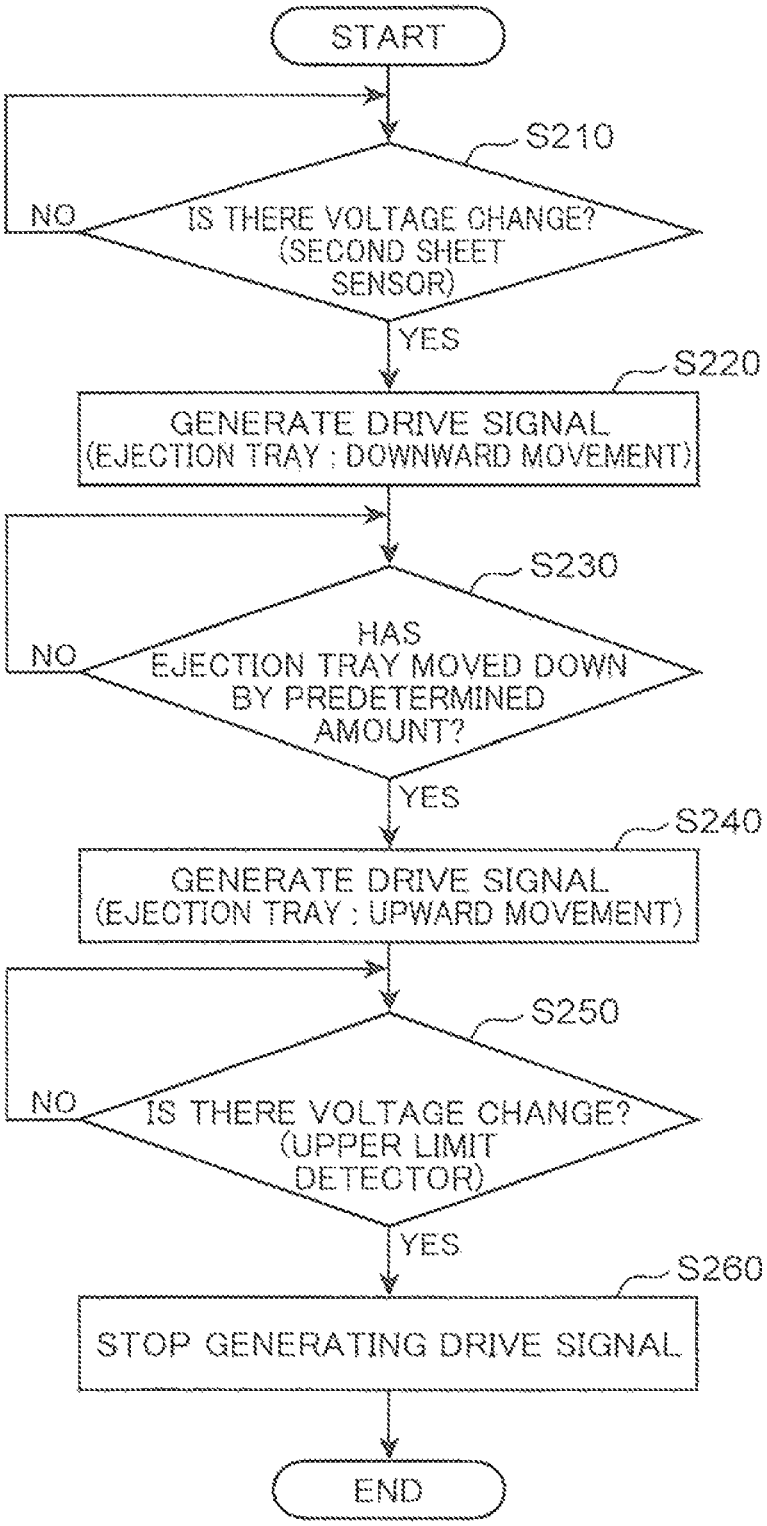
FIG. 16 is a schematic flowchart of an exemplificative process performed by a tray controller of the post-processing apparatus.

FIG. 16 is a schematic flowchart of an exemplificative process performed by the tray controller 122. The process performed by the tray controller 122 is described with reference to FIGS. 13, 15 and 16.

(Step S210)

The tray controller 122 waits for a change in voltage of the detection signal output from the second sheet sensor 36. As described above, the change in voltage of the detection signal output from the second sheet sensor 36 means the start of the ejection of a sheet stack from the process tray 32. With the change in voltage of the detection signal output from the second sheet sensor 36, the tray controller 122 executes step S220.

(Step S220)

The tray controller 122 generates a drive signal which instructs the downward movement of the ejection tray 24. The drive signal is output from the tray controller 122 to the tray driver 130. The tray driver 130 moves the ejection tray 24 down in response to the drive signal. As the result of the downward movement of the ejection tray 24, the inclined surface 243 of the ejection tray 24 departs downward from the second ejection roller pair 23. This forms a space wide enough to accept a thickness of the sheet stack ejected from the second ejection roller pair 23 between the inclined surface 243 of the ejection tray 24 and the tray cursor 311. After the start of the downward movement of the ejection tray 24, the tray controller 122 executes step S230.

(Step S230)

The tray controller 122 determines whether the ejection tray 24 has moved down by a predetermined amount on the basis of a period of time elapsed from the start of the downward movement of the ejection tray 24. The tray controller 122 executes step S230 until the ejection tray 24 has moved down by the predetermined amount (i.e. until the elapsed period of time has reached the predetermined value). When the ejection tray 24 has moved down by a predetermined amount, the tray controller 122 executes step S240.

(Step S240)

The tray controller 122 generates a drive signal which instructs the upward movement of the ejection tray 24. The drive signal is output from the tray controller 122 to the tray driver 130. The tray driver 130 moves the ejection tray 24 up in response to the drive signal. Then, the tray controller 122 executes step S250.

(Step S250)

The tray controller 122 waits for a change in voltage of the detection signal output from the upper limit detector 510. As described above, the change in voltage of the detection signal output from the upper limit detector 510 means that the upper surface of the sheet stack on the ejection tray 24 has entered the detection region which is formed by the upper limit detector 510. With the change in voltage of the detection signal output from the upper limit detector 510, the tray controller 122 executes step S260.

(Step S260)

The tray controller 122 stops generating the drive signal. Accordingly, the tray driver 130 and the ejection tray 24 are stopped.

Figure 17:
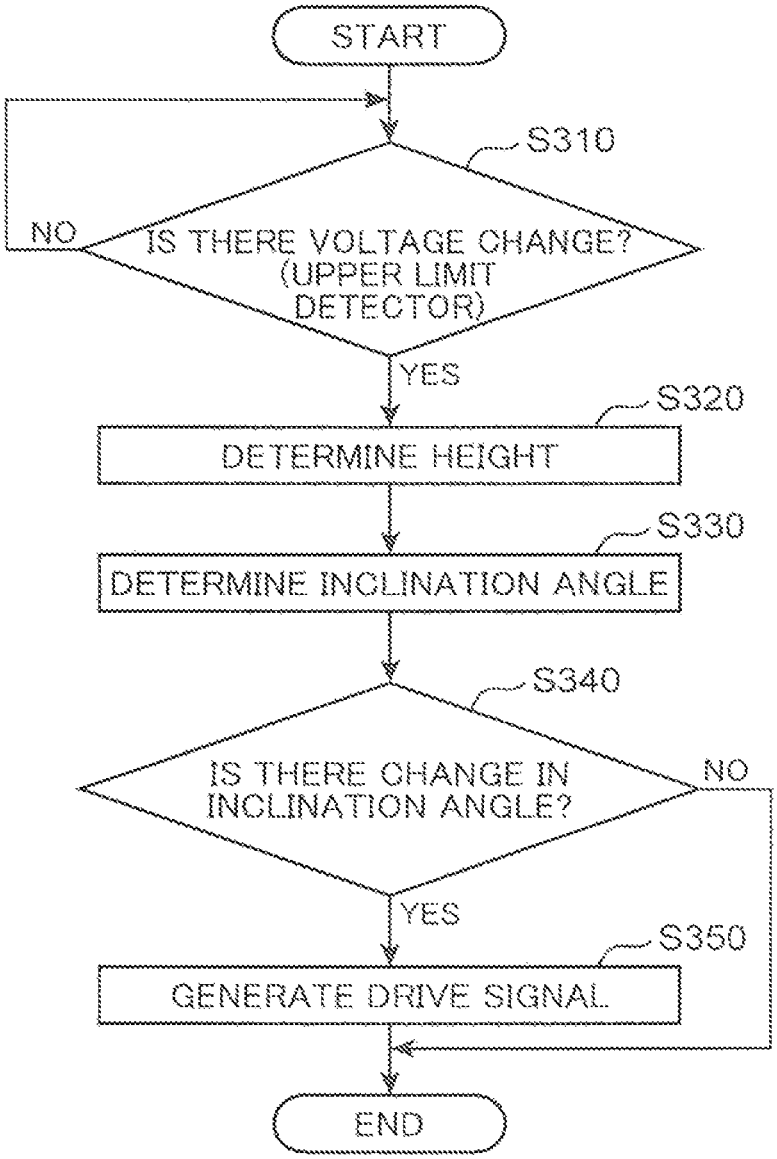
FIG. 17 is a schematic flowchart of an exemplificative process performed by an angle controller of the post-processing apparatus.

FIG. 17 is a schematic flowchart of an exemplificative process performed by the angle controller 123. The process performed by the angle controller 123 is described with reference to FIGS. 13, 15 and 17.

(Step S310)

The angle controller 123 waits for a change in voltage of the detection signal output from the upper limit detector 510. As described above, the change in voltage of the detection signal output from the upper limit detector 510 means that the upper surface of the sheet stack on the ejection tray 24 has entered the detection region which is formed by the upper limit detector 510. With the change in voltage of the detection signal output from the upper limit detector 510, the angle controller 123 executes step S320.

(Step S320)

The angle controller 123 determines a height of the ejection tray 24 with reference to the detection signal output from the height detector 520. After the determination about the height of the ejection tray 24, the angle controller 123 executes step S330.

(Step S330)

With regard to the present embodiment, the angle controller 123 has a look-up table in which heights of the ejection tray 24 are associated with inclination angles of the tray cursor 311. The angle controller 123 refers to the look-up table to determine an inclination angle of the tray cursor 311 on the basis of a height determined in step S320. Alternatively, the angle controller 123 may use another method (e.g. a predetermined function) to determine an inclination angle of the tray cursor 311 from a height of the ejection tray 24. The principles of the present embodiment are not limited to a specific method for determining an inclination angle of the tray cursor 311 from a height of the ejection tray 24.

(Step S340)

The angle controller 123 compares a current inclination angle of the tray cursor 311 to the inclination angle determined in step S330 in order to determine whether it is necessary to change the inclination angle of the tray cursor 311. The current inclination angle of the tray cursor 311 may be obtained from a signal output from a resolver (not shown) attached to a motor used as the angle changer 317. Alternatively, the angle controller 123 may have data indicating a previously changed inclination angle. The principles of the present embodiment are not limited to a specific method for obtaining the current inclination angle of the tray cursor 311. When the angle controller 123 determines that it is necessary to change the inclination angle of the tray cursor 311, the angle controller 123 executes step S350. Otherwise, the angle controller 123 ends the process.

(Step S350)

The angle controller 123 generates a drive signal. The drive signal is output from the angle controller 123 to the angle changer 317. The angle changer 317 causes the tray cursor 311 to swing around the rotation axis RAX in response to the drive signal.

(Adjustment of Lateral Position of Tray Cursor)

The post-processing apparatus 2 may be designed so that the tray cursor 311 is movable in a lateral direction orthogonal to the ejection direction of the sheet stack. In this case, the lateral position of the tray cursor 311 may be adjusted to match an operation mode of the post-processing apparatus 2 (e.g. a sorting mode in which an ejection position of an sheet stack is changed in the lateral direction). In addition, a lateral position of the tray cursor 311 may be adjusted to match a width of a sheet stack (a lateral size of a sheet stack). The post-processing apparatus 2 allowing the adjustment to the lateral position of the tray cursor 311 is described below.

Figure 18:
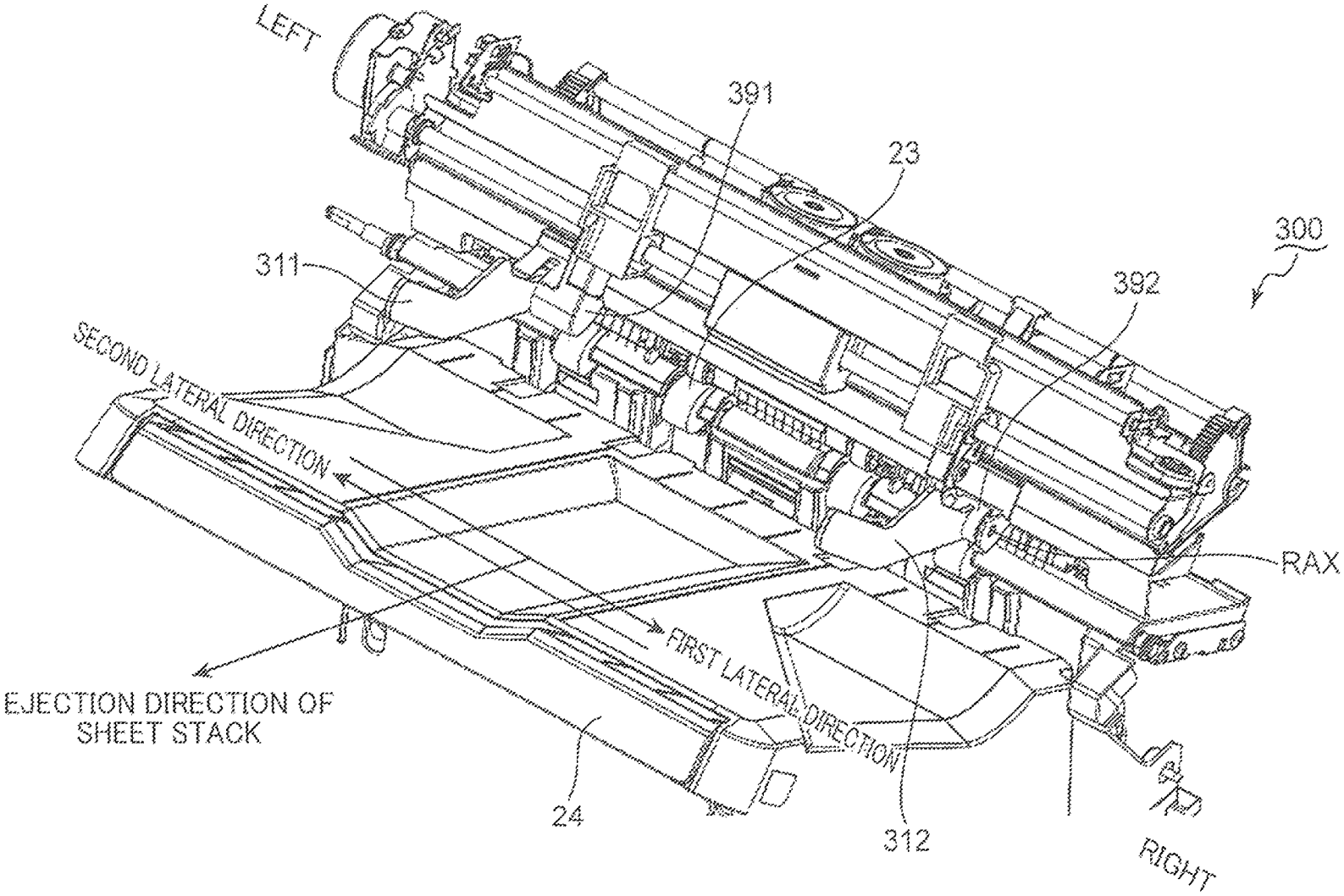
FIG. 18 is a schematic perspective view of a part of the post-processing apparatus.

FIG. 18 is a schematic perspective view of a part of the post-processing apparatus 2. The post-processing apparatus 2 is described with reference to FIGS. 13, 15, 17 and 18.

The curl prevention portion 300 includes a tray cursor 312 in addition to the tray cursor 311 and the angle changer 317. The tray cursor 312 may be identical in structure, shape and size to the tray cursor 311. Therefore, the description about the tray cursor 311 is applicable to the tray cursor 312.

The angle changer 317 includes a motor (not shown), which drives the tray cursor 311 exclusively, and another motor (not shown), which drives the tray cursor 312 exclusively. These motors synchronously swing the tray cursors 311, 312 around the rotation axis RAX in accordance with the aforementioned process with reference to FIG. 17. Therefore, the description about the operations of the tray cursor 311 is applicable to the tray cursor 312. With regard to the present embodiment, the two motors are used to drive the tray cursors 311, 312. However, the angle changer 317 may be designed so that a driving force of one motor is transferred to the tray cursors 311, 312 (e.g. a combination of belt and pulley). Therefore, the principles of the present embodiment are not limited to a specific structure of the angle changer 317.

The tray cursor 312 is distant from the tray cursor 311 in the lateral direction orthogonal to the ejection direction of the sheet stack. The direction from the tray cursor 311 to the tray cursor 312 is referred to as "first lateral direction" in the following description. The direction opposite to the first lateral direction is referred to as "second lateral direction" in the following description. With regard to the present embodiment, the second tray cursor is exemplified by the tray cursor 312.

The lateral positions (positions as seen from the lateral direction) of the tray cursors 311, 312 shown in FIG. 18 is referred to as "home positions" in the following description. During the drawing operation for a sheet into the process tray 32, the tray cursors 311, 312 are arranged at the home positions.

Figure 19:
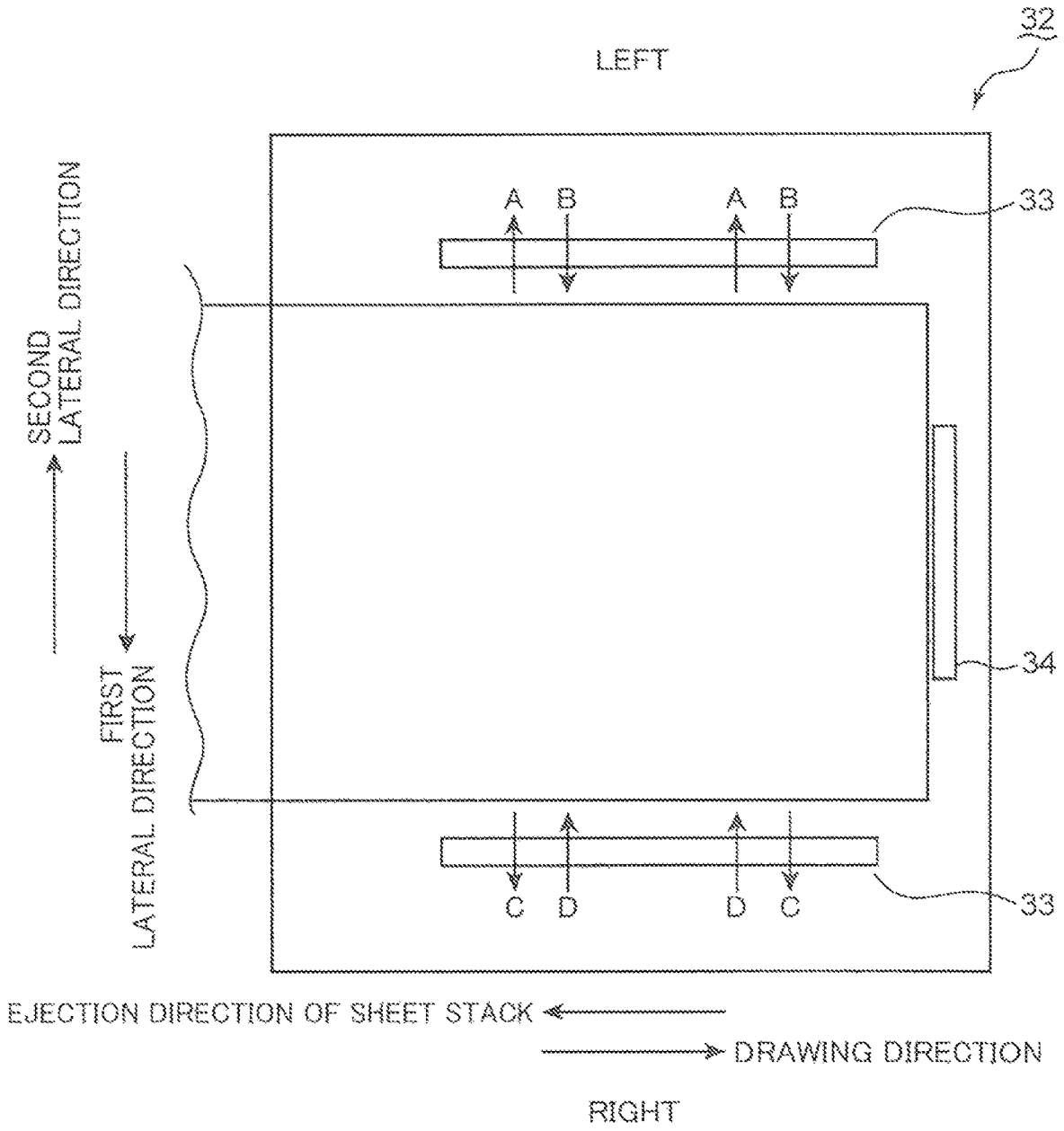
FIG. 19 is a schematic plane view of a process tray of the post-processing apparatus.

FIG. 19 is a schematic plane view of the process tray 32. The sorting operation of the process tray 32 is described with reference to FIGS. 18 and 19.

FIG. 19 shows four arrows A, B, C and D. The arrow A indicates a movement of the left alignment cursor 33 in the second lateral direction. The arrow B indicates a movement of the left alignment cursor 33 in the first lateral direction. The arrow C indicates a movement of the right alignment cursor 33 in the first lateral direction. The arrow D indicates a movement of the right alignment cursor 33 in the second lateral direction.

During the drawing operation, the movement of the left and right alignment cursors 33 represented by a set of the arrows A, C and the movement of the left and right alignment cursors 33 represented by a set of the arrows B, D are repeated. Accordingly, the side edges of the sheets stacked on the process tray 32 are aligned by the left and right alignment cursors 33.

When a user does not instruct a sorting mode in which ejection positions of sheet stacks are changed in the lateral direction, the second ejection roller pair 23 ejects a sheet stack onto the ejection tray 24, the sheet stack being formed at a position determined by the repeated movement of the left and right alignment cursors 33 which is represented by the set of the arrows A, C and the set of the arrows B, D. At this time, the tray cursors 311, 312 arranged at the home positions contact the upper surface of the sheet stack ejected by the second ejection roller pair 23. The position of the sheet stack ejected straight in the ejection direction from the position determined by the repeated movement of the left and right alignment cursors 33 which is represented by the set of the arrows A, C and the set of the arrows B, D is referred to as "home ejection position" in the following description.

When the user instructs the sorting mode in which ejection positions of sheet stacks are changed in the lateral direction, the movement of the left and right alignment cursors 33 represented by a set of the arrows A, D and the movement of the left and right alignment cursors 33 represented by a set of the arrows B, C are repeated. When the left and right alignment cursors 33 move respectively in directions represented by the arrows B, C, the second ejection roller pair 23 may eject the sheet stack into a first ejection position shifted from the home ejection position in the first lateral direction. When the left and right alignment cursors 33 move respectively in directions represented by the arrows A, D, the second ejection roller pair 23 may eject the sheet stack into a second ejection position shifted from the home ejection position in the second lateral direction. With regard to the present embodiment, the ejector is exemplified by the second ejection roller pair 23.

Figure 20:
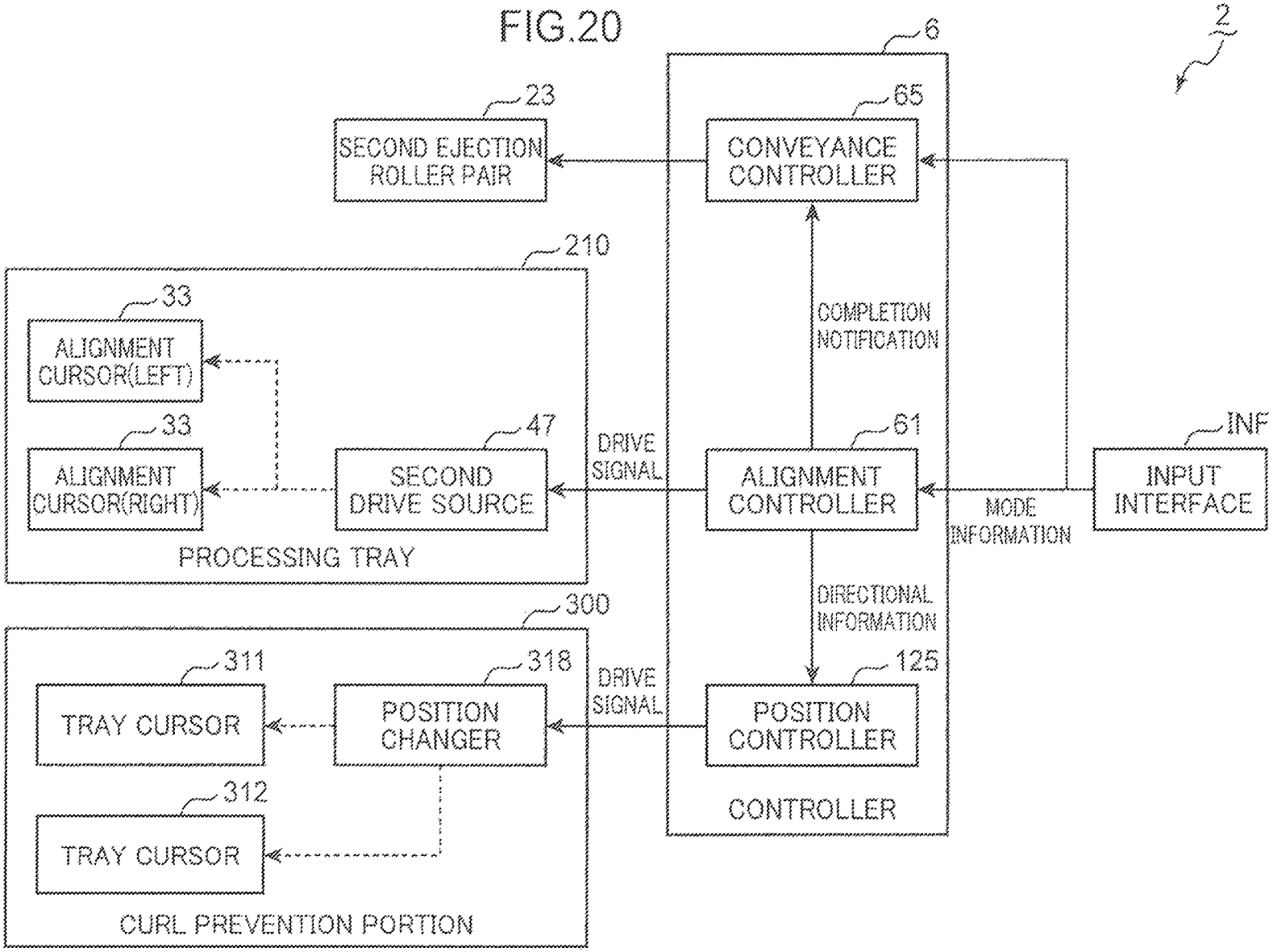
FIG. 20 is a schematic block diagram of an exemplificative functional configuration of the post-processing apparatus.

FIG. 20 is a schematic block diagram of an exemplificative functional configuration of the post-processing apparatus 2. The functional configuration of the post-processing apparatus 2 is described with reference to FIGS. 1, 19 and 20. Solid lines in FIG. 20 conceptually represent transfer of signals. Dotted lines in FIG. 20 conceptually represent transfer of forces.

FIG. 20 shows an input interface INF attached to the first housing 11 of the image formation apparatus 1. The user may operate the input interface INF to select the ejection mode of the post-processing apparatus 2. The input interface INF outputs mode information to the controller 6, the mode information indicating the ejection mode selected by the user.

The controller 6 includes a position controller 125 in addition to the alignment controller 61 and the conveyance controller 65. The alignment controller 61 receives the mode information from the input interface INF. When the mode information indicates that the user has selected the sorting mode as the ejection mode, the movement of the left and right alignment cursors 33 represented by a set of the arrows A, D and the movement of the left and right alignment cursors 33 represented by a set of the arrows B, C are repeated.

When the mode information indicates that the user has selected the sorting mode as the ejection mode, the alignment controller 61 executes a predetermined program to generate a drive signal for repeating the movement of the left and right alignment cursors 33 represented by the set of the arrows A, D and the set of the arrows B, C. The drive signal is output from the alignment controller 61 to the second drive source 47. The second drive source 47 has various mechanisms to move the left and right alignment cursors 33 in the directions represented by the arrows A, B, C, D. For example, the second drive source 47 may be a combination of a motor, a clutch, a belt and a pulley. Alternatively, the second drive source 47 may be cylinder devices coupled to the left and right alignment cursors 33. The principles of the present embodiment are not limited to a specific structure of the second drive source 47.

Upon completion of generation of the drive signal for moving the left and right alignment cursors 33 in the first lateral direction (the arrows B, C), the alignment controller 61 generates a completion notification. Likewise, upon completion of generation of the drive signal for moving the left and right alignment cursors 33 in the second lateral direction (the arrows A, D), the alignment controller 61 generates a completion notification. These completion notifications are output from the alignment controller 61 to the conveyance controller 65.

Like the alignment controller 61, the conveyance controller 65 also receives the mode information. When the mode information indicates that the user has selected the sorting mode as the ejection mode, the conveyance controller 65 causes the second ejection roller pair 23 to start ejecting a sheet stack from the process tray 32 in response to the completion notifications. When the user has not selected the sorting mode as the ejection mode, the second ejection roller pair 23 starts ejecting the sheet stack from the process tray 32 at the time of the completion of the operation by the stapler 31 (see FIG. 1) as a trigger.

The alignment controller 61 generates directional information indicating a movement direction of the left and right alignment cursors 33 in synchronization with the generation of the drive signal. The directional information is transferred from the alignment controller 61 to the position controller 125. The position controller 125 generates a drive signal with reference to the directional information. When the directional information indicates the movement of the left and right alignment cursors 33 in the first lateral direction (the arrows B, C), the position controller 125 generates a drive signal for moving the tray cursor 311 in the first lateral direction. When the directional information indicates the movement of the left and right alignment cursors 33 in the second lateral direction (the arrows A, D), the position controller 125 generates a drive signal for moving the tray cursor 312 in the second lateral direction.

The curl prevention portion 300 further includes a position changer 318 which moves the tray cursors 311, 312 in the first and second lateral directions. The position changer 318 receives the drive signal from the position controller 125. The position changer 318 moves the tray cursors 311, 312 in the first and second lateral directions in response to the drive signal. Therefore, even when the ejection position of the sheet stack is changed from the home ejection position to the first and second ejection positions, the tray cursors 311, 312 may contact the sheet stack ejected by the second ejection roller pair 23 to prevent the sheet stack from curling.

Figure 21:
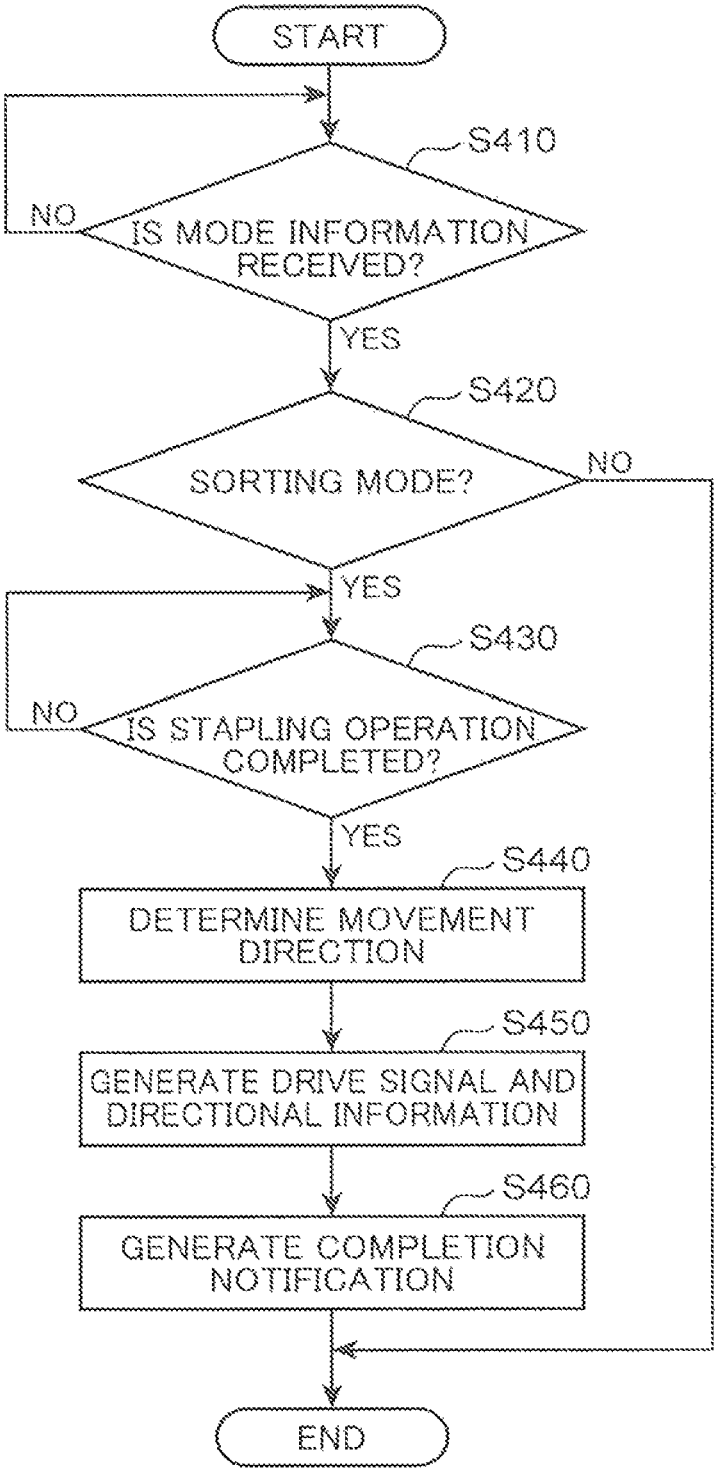
FIG. 21 is a schematic flowchart of an exemplificative process performed by an alignment controller of the post-processing apparatus.

FIG. 21 is a schematic flowchart of an exemplificative process performed by the alignment controller 61 when the user has selected the sorting mode as the ejection mode. The process performed by the alignment controller 61 is described with reference to FIGS. 20 and 21.

(Step S410)

The alignment controller 61 waits for the mode information. Upon reception of the mode information from the input interface INF, the alignment controller 61 executes step S420.

(Step S420)

The alignment controller 61 refers to the mode information to determine whether the user has selected the sorting mode as the ejection mode. When the user has selected the sorting mode, the alignment controller 61 executes step S430. Otherwise, the alignment controller 61 does not execute the process for the sorting mode.

(Step S430)

The alignment controller 61 waits for completion of operation of the stapler 31. When the stapler 31 staples the sheet stack on the process tray 32, the alignment controller 61 executes step S440.

(Step S440)

The alignment controller 61 executes a predetermined program prepared for the sorting mode to determine the movement direction of the left and right alignment cursors 33. Various programs for the sorting mode in known post-processing apparatuses may be used to determine the movement direction of the left and right alignment cursors 33. Therefore, the principles of the present embodiment are not limited to a specific process for determining the movement direction of the left and right alignment cursors 33. After determining the movement direction of the left and right alignment cursors 33, the alignment controller 61 executes step S450.

(Step S450)

The alignment controller 61 generates a drive signal for moving the left and right alignment cursors 33 in the direction determined in step S440. The drive signal is output from the alignment controller 61 to the second drive source 47. When the movement of the left and right alignment cursors 33 in the first lateral direction (the arrows B, C) is determined in step S440, the second drive source 47 moves the left and right alignment cursors 33 in the first lateral direction in response to the drive signal. When the movement of the left and right alignment cursors 33 in the second lateral direction (the arrows A, D) is determined in step S440, the second drive source 47 moves the left and right alignment cursors 33 in the second lateral direction in response to the drive signal.

The alignment controller 61 generates the directional information in synchronization with the generation of the drive signal. The directional information is output from the alignment controller 61 to the position controller 125. When the movement of the left and right alignment cursors 33 in the first lateral direction (the arrows B, C) is determined in step S440, the position controller 125 generates a drive signal for moving the tray cursor 311 in the first lateral direction. When the movement of the left and right alignment cursors 33 in the second lateral direction (the arrows A, D) is determined in step S440, the position controller 125 generates a drive signal for moving the tray cursor 312 in the second lateral direction. The drive signal is output from the position controller 125 to the position changer 318. The position changer 318 moves the tray cursor 311 in the first lateral direction or moves the tray cursor 312 in the second lateral direction in response to the drive signal. Upon completion of generation of the drive signal and the directional information, the alignment controller 61 executes step S460.

(Step S460)

The alignment controller 61 generates the completion notification. The completion notification is output from the alignment controller 61 to the conveyance controller 65. The conveyance controller 65 starts ejecting the sheet stack from the process tray 32 in response to the completion notification.

Figure 22:
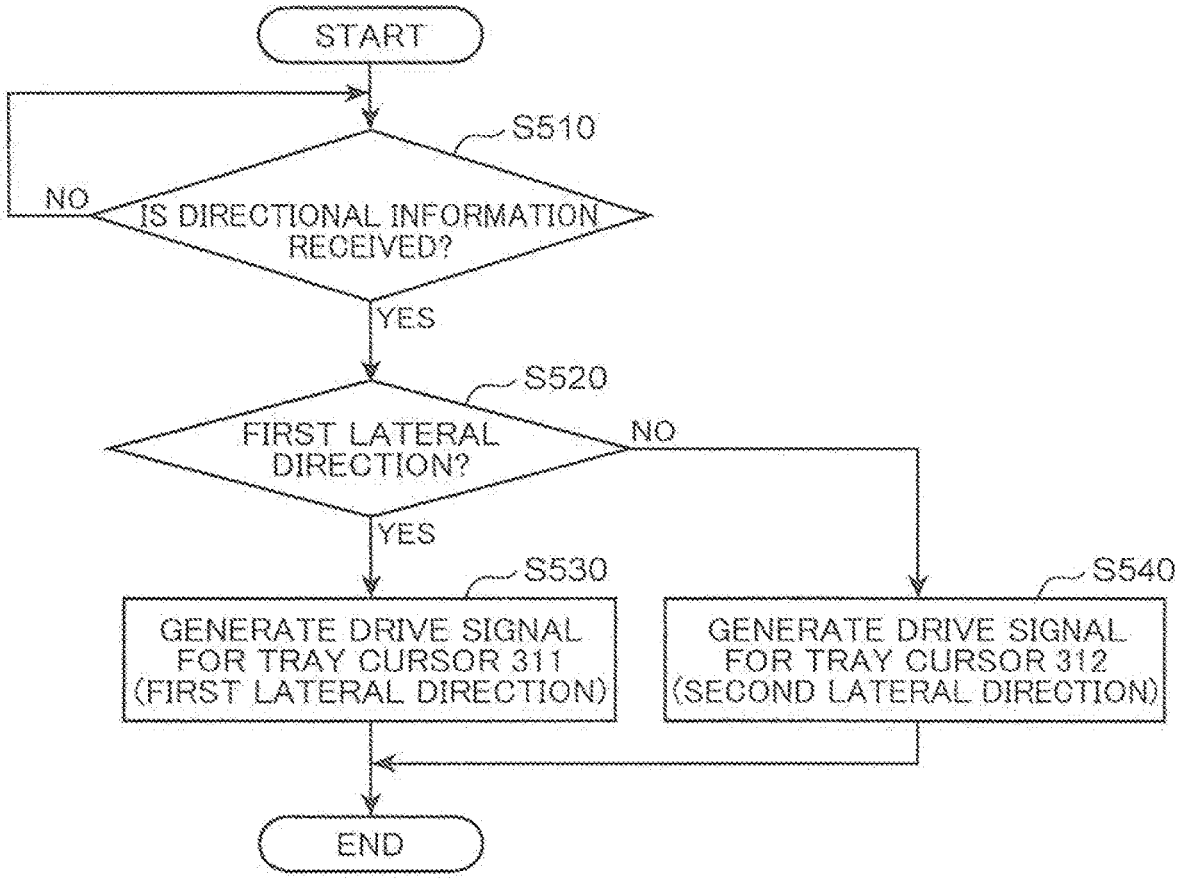
FIG. 22 is a schematic flowchart of a process performed by a position controller of the post-processing apparatus.

FIG. 22 is a schematic flowchart of a process performed by the position controller 125. The process performed by the position controller 125 is described with reference to FIGS. 18, 20, and 22.

(Step S510)

The position controller 125 waits for the directional information. Upon receipt of the directional information from the alignment controller 61, the position controller 125 executes step S520.

(Step S520)

The position controller 125 refers to the directional information to determine whether the directional information indicates the movement of the left and right alignment cursors 33 in the first lateral direction. The directional information indicating the movement of the left and right alignment cursors 33 in the first lateral direction means that the ejection position of the sheet stack has changed from the home ejection position or the second ejection position to the first ejection position. The directional information indicating the movement of the left and right alignment cursors 33 in the second lateral direction means that the ejection position of the sheet stack has changed from the home ejection position or the first ejection position to the second ejection position. When the directional information indicates the movement of the left and right alignment cursors 33 in the first lateral direction, the position controller 125 executes step S530. Otherwise, the position controller 125 executes step S540.

(Step S530)

The position controller 125 generates a drive signal for the tray cursor 311. The drive signal is output from the position controller 125 to the position changer 318. The position changer 318 moves the tray cursor 311 in the first lateral direction in response to the drive signal. Meanwhile, the tray cursor 312 remains still.

(Step S540)

The position controller 125 generates a drive signal for the tray cursor 312. The drive signal is output from the position controller 125 to the position changer 318. The position changer 318 moves the tray cursor 312 in the second lateral direction in response to the drive signal. Meanwhile, the tray cursor 311 remains still.

With regard to the aforementioned embodiment, the position changer 318 selectively moves one of the tray cursors 311, 312 in the lateral direction. However, the position changer 318 may move both of the tray cursors 311, 312. For example, the position changer 318 may move both of the tray cursors 311, 312 in the lateral direction to set the lateral positions of the tray cursors 311, 312 at an interval suitable for a width of the sheet stack.

In the aforementioned embodiment, the post-processing apparatus 2 includes the two tray cursors 311, 312. However, the post-processing apparatus may have either one of the tray cursors 311, 312. Alternatively, the post-processing apparatus may further have another tray cursor in addition to the tray cursors 311, 312. The principles of the present embodiment are not limited by how many tray cursors the post-processing apparatus has.

(Structure of Position Changer)

The position changer 318 (c.f. FIG. 20) may have various structures for moving selectively the tray cursors 311, 312. An exemplificative structure of the position changer 318 is described below.

As shown in FIG. 18, the curl prevention portion 300 includes two storage cases 391, 392. The proximal end (not shown) of the tray cursor 311 is stored in the storage case 391. The proximal end (not shown) of the tray cursor 312 is stored in the storage case 392.

The angle changer 317 described with reference to FIG. 15 includes a first motor (not shown) and a second motor (not shown). The first motor is situated in the storage case 391. The proximal end of the tray cursor 311 is coupled to the first motor in the storage case 391. The second motor is situated in the storage case 392. The proximal end of the tray cursor 312 is coupled to the second motor in the storage case 392. The first and second motors swing the tray cursors 311, 312 around the rotation axis RAX in accordance with the control principle described with reference to FIG. 17.

Figure 23:
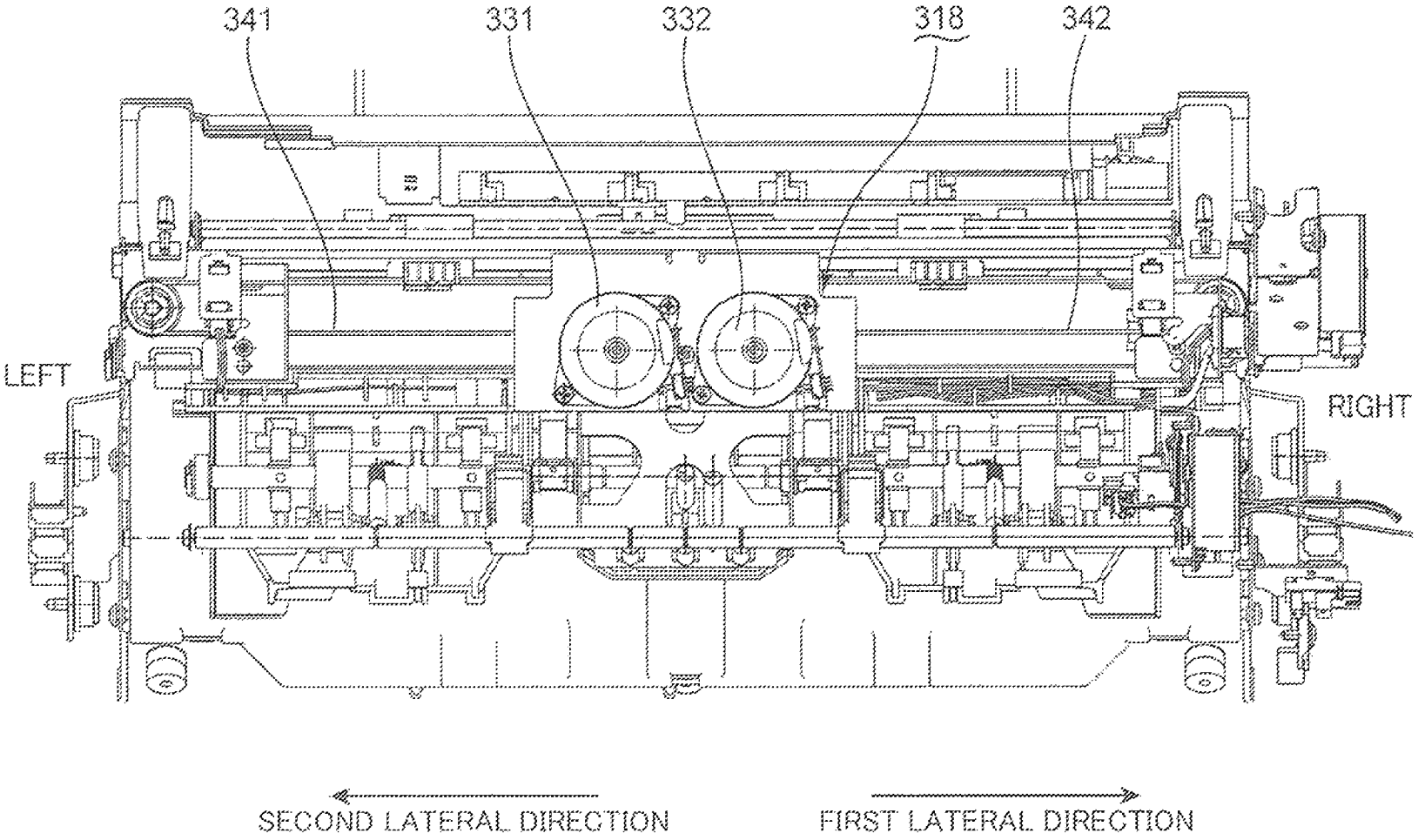
FIG. 23 is a schematic front view of a position changer of the post-processing apparatus.

FIG. 23 is a schematic front view of the position changer 318. The position changer 318 is described with reference to FIGS. 18, 20, 22 and 23.

The position changer 318 is situated upstream of the storage cases 391, 392 as seen from the ejection direction of the sheet stack. The position changer 318 includes two motors 331, 332 and two endless belts 341, 342.

When step S530 is executed as described with reference to FIG. 22, the motor 331 receives the drive signal from the position controller 125. The endless belt 341 is extended from the motor 331 in the second lateral direction and wound around a pulley (not shown). The storage case 391 is coupled to the endless belt 341. When step S530 is executed, the tray cursor 311 is moved together with the storage case 391 by the motor 331 and the endless belt 341 in the first lateral direction.

When step S540 is executed as described with reference to FIG. 22, the motor 332 receives the drive signal from the position controller 125. The endless belt 342 is extended from the motor 332 in the first lateral direction and wound around another pulley (not shown). The storage case 392 is coupled to the endless belt 342. When step S540 is executed, the tray cursor 312 is moved together with the storage case 392 by the motor 332 and the endless belt 342 in the second lateral direction.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A post-processing apparatus to perform a predetermined post-process after an image formation process for forming an image, the post-processing apparatus comprising:

an ejection tray that supports a sheet stack ejected after the post-process; and a curl prevention portion including: a first tray cursor that abuts an upper surface of the sheet stack on the ejection tray to prevent the sheet stack from curling; and a position changer that moves the first tray cursor in a first lateral direction orthogonal to an ejection direction of the sheet stack ejected onto the ejection tray or a second lateral direction opposite to the first lateral direction, the curl prevention portion including an angle changer that changes an inclination angle of the first tray cursor with respect to the ejection tray, wherein:

the angle changer sets the inclination angle to a first value when a number of sheets forming the sheet stack is a first number, and the angle changer sets the inclination angle to a second value different from the first value when the number of the sheets is a second number different from the first number.

2. The post-processing apparatus according to claim 1, wherein the first tray cursor includes a distal end that is distant from a predetermined rotation axis in the ejection direction, and wherein the angle changer rotates the first tray cursor around the rotation axis to make the distal end depart upward from the ejection tray when the number of the sheets increases from the first number to the second number.

3. The post-processing apparatus according to claim 2, further comprising:

a tray driver that drives the ejection tray so that the ejection tray moves from a first height position to a second height position that is lower than the first height position when the number of the sheets increases from the first number to the second number; and a tray detector that detects a height position of the ejection tray and generates a detection signal representing the detected height position, wherein the angle changer moves up the distal end in response to the detection signal.

4. The post-processing apparatus according to claim 1, wherein the curl prevention portion includes a second tray cursor that is distant from the first tray cursor in the first lateral direction, and wherein the position changer moves the second tray cursor in the first or second lateral direction.

5. The post-processing apparatus according to claim 4, further comprising:

an ejector configured for selectively ejecting the sheet stack to one of: a home ejection position at which the sheet stack contacts the first and second tray cursors that are arranged at predetermined home positions; a first ejection position shifted from the home ejection position in the first lateral direction; and a second ejection position shifted from the home ejection position in the second lateral direction, wherein the position changer moves the first tray cursor in the first lateral direction when an ejection position of the sheet stack is changed from the home ejection position or the second ejection position to the first ejection position, and wherein the position changer moves the second tray cursor in the second lateral direction when the ejection position is changed from the home ejection position or the first ejection position to the second ejection position.

6. The post-processing apparatus according to claim 5, further comprising:

a process tray situated below a conveyance path to receive the sheets sequentially, the sheets being sequentially conveyed along the conveyance path in a predetermined conveyance direction;

a tapping unit including a tapping portion configured to tap a sheet positioned above the process tray toward the process tray;

first and second alignment cursors to align side edges of the sheets on the process tray in a width direction that is orthogonal to the conveyance direction;

a post-processing portion to perform the post-process on the sheet stack placed in a predetermined position on the process tray;

a first drive source to drive the tapping portion;

a second drive source to drive the first and second alignment cursors; and a controller to control operations of the first and second drive sources, wherein the controller performs a first control to actuate the first drive source so that the tapping portion executes sheet tapping, and then to actuate the second drive source so that the first and second alignment cursors execute an alignment operation when a size of the sheet is smaller in the width direction than a predetermined size, and wherein the controller performs a second control to actuate the first and second drive sources at the same time and to execute the sheet tapping and the alignment operation at the same time when the size of the sheets is no less in the width direction than the predetermined size.

7. The post-processing apparatus according to claim 6, wherein the tapping unit includes a shaft member that is situated to extend in the width direction above the process tray, the shaft member having a first end side and a second end side, wherein the tapping portion includes first and second tapping members attached respectively to the first end side and the second end side of the shaft member, wherein an operating range of the first alignment cursor overlaps an operable range of the first tapping member on the first end side, and wherein an operating range of the second alignment cursor overlaps an operable range of the second tapping member on the second end side.

8. The post-processing apparatus according to claim 7, wherein the tapping members rotate around the shaft member to change in orientation between a tapping orientation in which the tapping members approach the process tray and a retracted orientation in which the tapping members depart from the process tray, wherein the first and second alignment cursors are movable in a direction in which the first and second alignment cursors come closer to each other and in a direction in which the first and second alignment cursors move apart from each other in the width direction, and wherein the controller, when performing the first control, causes the tapping members to take the tapping orientation for the sheet tapping and to change the tapping orientation to the retracted orientation, and then causes the first and second alignment cursors to execute the alignment operation.

* * * * *